US011345178B2

(12) United States Patent
Walter et al.

(10) Patent No.: US 11,345,178 B2
(45) Date of Patent: May 31, 2022

(54) SECURITY ELEMENT, AND METHOD FOR PRODUCING A SECURITY ELEMENT

(71) Applicant: OVD Kinegram AG, Zug (CH)

(72) Inventors: Harald Walter, Horgen (CH); Corrado Fraschina, Lucerne (CH); Sebastian Mader, Baar (CH)

(73) Assignee: OVD KINEGRAM AG, Zug (CH)

( * ) Notice: Subject to any disclaimer, the term of this patent is extended or adjusted under 35 U.S.C. 154(b) by 26 days.

(21) Appl. No.: 16/496,775

(22) PCT Filed: Mar. 23, 2018

(86) PCT No.: PCT/EP2018/057465
§ 371 (c)(1),
(2) Date: Sep. 23, 2019

(87) PCT Pub. No.: WO2018/172528
PCT Pub. Date: Sep. 27, 2018

(65) Prior Publication Data

US 2021/0107312 A1 Apr. 15, 2021

(30) Foreign Application Priority Data

Mar. 24, 2017 (DE) ..... 102017106433.8

(51) Int. Cl.
*B42D 25/324* (2014.01)
*B42D 25/328* (2014.01)
(Continued)

(52) U.S. Cl.
CPC ..... *B42D 25/324* (2014.10); *B42D 25/328* (2014.10); *B42D 25/337* (2014.10);
(Continued)

(58) Field of Classification Search
CPC .. B42D 25/324; B42D 25/373; B42D 25/328; B42D 25/41; B42D 25/337; B42D 25/23; B42D 25/29; B42D 25/24
(Continued)

(56) References Cited

U.S. PATENT DOCUMENTS 6,602,578 B1 8/2003 Tompkin et al.
7,468,842 B2 12/2008 Steenblik et al.
(Continued)

FOREIGN PATENT DOCUMENTS

CN 1423598 6/2003
CN 1423598 A 6/2003
(Continued)

*Primary Examiner* — Justin V Lewis
(74) *Attorney, Agent, or Firm* — Hoffmann & Baron, LLP

(57) ABSTRACT

A security element with one or more first microstructures, wherein the first microstructures are provided in each case in one or more tracks which are curved at least in sections or in one or more sections of a track which are curved at least in sections, and/or in each case run along one or more tracks which are curved at least in sections or along one or more sections of a track which are curved at least in sections, and a method, wherein at least one file containing image points of one or more image elements is provided, which includes the locational arrangement of the image points, and one or more tracks which are curved at least in sections or one or more sections of one or more tracks which are curved at least in sections are determined from the locational arrangement of the image points, and in the one or more tracks or sections of tracks in each case one or more first microstructures are provided which, when illuminated, provide a first item of optically variable information.

44 Claims, 26 Drawing Sheets

(51) Int. Cl.

| | |
|---|---|
| ***B42D 25/337*** | (2014.01) |
| ***B42D 25/373*** | (2014.01) |
| ***B42D 25/41*** | (2014.01) |
| *B42D 25/23* | (2014.01) |
| *B42D 25/24* | (2014.01) |
| *B42D 25/29* | (2014.01) |

(52) U.S. Cl.
CPC ..... *B42D 25/373* (2014.10); *B42D 25/41* (2014.10); *B42D 25/23* (2014.10); *B42D 25/24* (2014.10); *B42D 25/29* (2014.10)

(58) Field of Classification Search
USPC ..... 283/72, 74, 94, 98, 901
See application file for complete search history.

(56) References Cited

U.S. PATENT DOCUMENTS

| | | | | |
|---|---|---|---|---|
| 8,928,978 | B2 | 1/2015 | Tompkin et al. | |
| 9,983,335 | B2 | 5/2018 | Tompkin et al. | |
| 10,195,889 | B2 | 2/2019 | Brehm et al. | |
| 10,252,562 | B2 | 4/2019 | Holmes | |
| 2004/0101676 | A1 | 5/2004 | Phillips et al. | |
| 2006/0198998 | A1 | 9/2006 | Raksha et al. | |
| 2013/0154250 | A1 | 6/2013 | Dunn et al. | |
| 2014/0037898 | A1 | 2/2014 | Tompkin et al. | |
| 2016/0147076 | A1 | 5/2016 | Rich et al. | |
| 2016/0167422 | A1* | 6/2016 | Brehm ..... | B42D 25/328 359/567 |
| 2018/0015771 | A1 | 1/2018 | Tompkin et al. | |
| 2018/0117947 | A1 | 5/2018 | Fuhse | |

FOREIGN PATENT DOCUMENTS

| | | | | |
|---|---|---|---|---|
| DE | 10 2004 006 771 | | 9/2005 | |
| DE | 102004006771 | A1 | 9/2005 | |
| DE | 102008005019 | | 7/2009 | |
| DE | 102008005019 | A1 | 7/2009 | |
| DE | 10 2015 005 969 | | 11/2016 | |
| DE | 102015005969 | A1 | 11/2016 | |
| EP | 2 489 524 | | 8/2012 | |
| EP | 2489524 | A1 | 8/2012 | |
| GB | 2542253 | | 3/2017 | |
| GB | 2542253 | A | 3/2017 | |
| JP | 2002541001 | A | 12/2002 | |
| JP | 2006203627 | | 8/2006 | |
| JP | 2006203627 | A | 8/2006 | |
| JP | 2011022478 | | 2/2011 | |
| JP | 2011022478 | A | 2/2011 | |
| JP | 2016203627 | | 12/2016 | |
| JP | 2016203627 | A | 12/2016 | |
| JP | 2017032493 | | 2/2017 | |
| JP | 2017032493 | A | 2/2017 | |
| JP | 2017505926 | A | 2/2017 | |
| JP | 2018134840 | A | 8/2018 | |
| TW | 200642770 | | 12/2006 | |
| TW | 200642770 | A | 12/2006 | |
| TW | 201345744 | | 11/2013 | |
| TW | 201345744 | A | 11/2013 | |
| WO | 2011079347 | A1 | 7/2011 | |
| WO | WO 2011/079347 | | 7/2011 | |
| WO | 2014/187665 | A1 | 11/2014 | |
| WO | WO 2014/187665 | | 11/2014 | |
| WO | WO-2014187665 | A1 * | 11/2014 | ..... G02B 27/4244 |
| WO | 2016/110493 | A1 | 7/2016 | |
| WO | WO 2016/110493 | | 7/2016 | |
| WO | 2017015748 | A1 | 2/2017 | |
| WO | WO 2017/015748 | | 2/2017 | |

* cited by examiner

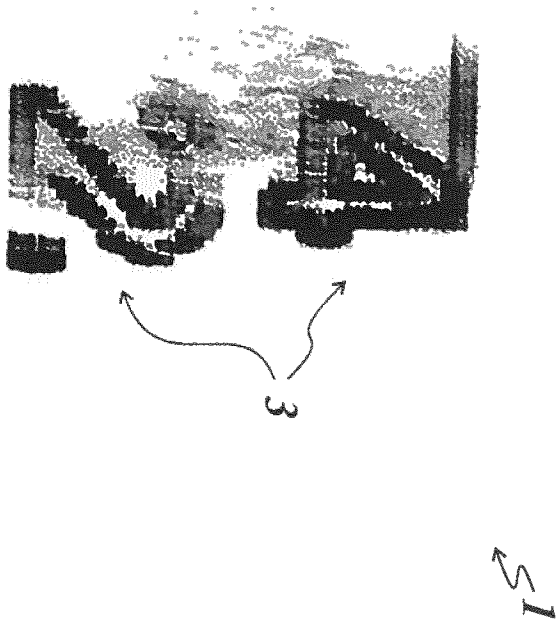
Fig. 9a
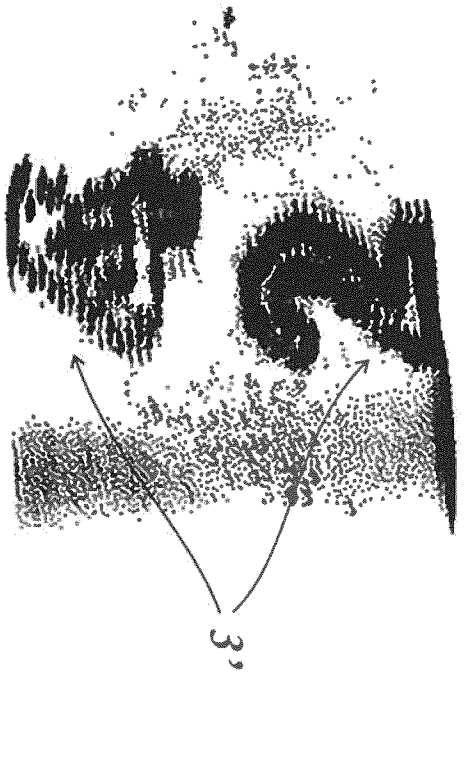
Fig. 9b
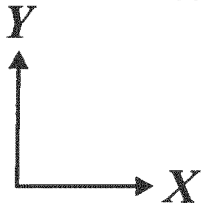

(a)

SECURITY ELEMENT, AND METHOD FOR PRODUCING A SECURITY ELEMENT

This application claims priority based on an International Application filed under the Patent Cooperation Treaty, PCT/EP2018/057465, filed Mar. 23, 2018, which claims priority to DE 102017106433.8, filed Mar. 24, 2017.

BACKGROUND OF THE INVENTION

The invention relates to a security element and a method for producing a security element.

Security elements in a variety of designs are known from the state of the art. Security elements serve in particular to bring about a security effect and to mark the authenticity of an object. Security elements further serve in particular to make manipulation, preferably forgery, of objects more difficult. Security elements in the field of security documents such as for example ID documents and value documents such as for example banknotes are of particularly great importance.

SUMMARY OF THE INVENTION

The object of the invention now is to specify an improved security element and an improved method for producing a security element which has a particularly good visual effect.

The object is achieved by a security element according to claim 1, and a method according to claim 63.

Such a security element and method are characterized in that one or more first microstructures are provided or produced, wherein the first microstructures are provided in each case in one or more tracks which are curved at least in sections or in one or more sections of a track which are curved at least in sections, and/or in each case run along one or more tracks which are curved at least in sections or along one or more sections of a track which are curved at least in sections.

A method for producing such a security element is characterized in that at least one file containing image points of one or more image elements is provided, which comprises the locational arrangement of the image points, in that one or more tracks which are curved at least in sections or one or more sections of one or more tracks which are curved at least in sections are determined from the locational arrangement of the image points, in that in the one or more tracks or sections of tracks in each case one or more first microstructures are provided which, when illuminated, provide a first item of optically variable information, in particular provide one or more 3D effects (3D=three-dimensional) and/or movement effects, preferably provide achromatic or monochromatic 3D effects and/or movement effects.

It is hereby achieved that security elements can be checked for their authenticity and the protection against forgery of the security element is hereby further improved.

It has surprisingly been shown that through the invention one or more visually appealing, strong movement, morphing and/or flip effects of one or more image elements and/or one or more visually appealing, very strong 3D movement, 3D morphing and/or 3D flip effects of one or more image elements can be achieved. Depending on the choice of the structures, the effects can further preferably be formed achromatic or monochromatic. By a morphing effect is meant a metamorphosis, transformation or transition of one motif into another motif. This metamorphosis, transformation or transition can have several intermediate stages.

By a flip effect is preferably meant a changeover of one motif to another motif. The changeover takes place in particular without intermediate stages.

Advantageous designs of the invention are described in the dependent claims.

A security element generates an item of information detectable for the human observer. This item of information can be optically variable. By optical variability is meant a dependence of the optical appearance of the item of information on an observation and/or illumination angle. A security element, in particular an optical security element, here can preferably consist of the transfer ply of a transfer film, of a laminating film or of a film element or the security element can be introduced directly into the surface of an object. The security element, in particular an optical security element, here can preferably be applied to the surface of the security document or at least partially embedded in the security document.

Under irradiation with light the first microstructures preferably generate one or more optical effects detectable for a human observer or by machine. The wavelengths that can be detected by the human eye lie in the range between 380 nm (violet) and 780 nm (dark red) of the electromagnetic spectrum, wherein the relative sensitivity of the eye below 430 nm and above 690 nm is less than 1% of the maximum value at 555 nm. As a result, only very strong light sources such as for example bright LEDs or lasers are perceived in the spectral ranges 380 nm to 430 nm and 690 nm to 780 nm.

The first microstructures together preferably provide a first item of optically variable information. This first item of optically variable information preferably comprises one or more 3D effects and/or movement effects. These effects are preferably achromatic or monochromatic. In the case of achromatic effects, no or almost no diffractive color effects occur and the image elements appear white or grayish, matte or shiny metallic to the human observer. In the case of the monochromatic effects, the image elements display a substantially single-colored appearance and in particular not the rainbow effects occurring in the case of "usual" diffraction structures.

The first item of optically variable information preferably has one or more image elements. These image elements are preferably composed of several image points.

The image points here are in each case preferably provided by first microstructures, which are provided in different tracks or run along different tracks.

The image points of the image elements are thus provided in each case by one or more of the first microstructures, which scatter, reflect or diffract the incident light on the basis of their arrangement in one or more tracks or sections of one or more tracks in order to provide the image points in predetermined observation and/or illumination directions.

Each image point of the one or more image elements is thus preferably provided by one of the allocated first microstructures and each of the allocated first microstructures is provided on a respectively allocated track of the one or more tracks or runs along a respectively allocated track. Here, a different one of the one or more tracks is preferably allocated to each of the image points of an image element. The microstructures allocated to the respective track are further preferably designed such that the image points move along the allocated track when the security element is tilted and/or bent and/or rotated, when illuminated with at least one light source, preferably with a point light source. Here, preferably only one image point per track appears when illuminated with a single point light source.

The one or more first microstructures are preferably provided in such a way that the image points of one or more image elements move preferably at a constant distance relative to each other. Here, the image points migrate or move in particular with each other or coupled relative to each other, wherein the image element preferably does not change.

It is also possible for the one or more first microstructures to be provided in such a way that the distance of the image points relative to each other preferably changes. In particular, it is possible for the arrangement of the image points to represent the image element only in a narrow observation angle range. If on the other hand the security element is observed outside this narrow observation angle range, the image points are preferably to be seen in a randomly appearing arrangement, which in particular does not represent the image element, but preferably as a point cloud.

By "bending" is preferably meant the deformation of the security element in a particular manner due to the exertion of a force. By "bending" of a security element is therefore meant in particular the exertion of force on the security element, wherein the shape of the security element is changed or can be changed by the force effect. A bent security element thus has a changed geometry, in particular curvature, in comparison with the unbent security element.

The movement speed of the image points along the respective track at a constant angular speed during the tilting and/or bending and/or rotation of the security element can here be identical to or different from each other and/or the image points can have different movement speed curves from each other. Through the corresponding choice of the movement speed and/or of the movement speed curve of the image points on the respective tracks, interesting optically variable effects can be generated as first item of optically variable information. The spatial arrangement and the spatial progression of the image points can be determined through the corresponding selection of the microstructures respectively provided on the tracks and/or sections of the tracks:

Preferably one or more movement effects, in particular optical movement effects, of one or more of the image elements in each case along the at least one track in particular due to one or more rotations and/or bends and/or tilts of a security element having the at least one track about one or more arbitrary axes can hereby be registered by an observer. In particular, in the case of one or more rotations about one or more axes perpendicular to the plane of the security element and/or in the case of one or more tilts about one or more axes and/or in the case of one or more bends about one or more axes in the plane of the security element and thus in the plane of the first microstructures and/or tracks, such movement effects can be registered by an observer. Further, one or more of the movement effects can preferably in each case be an achromatic and/or monochromatic movement effect and/or a movement effect dependent on an illumination and/or observation angle.

Further, in particular when the security element is tilted and/or bent and/or rotated a sequence of image elements which produce a movement effect, a morphing effect and/or a flip effect can be provided by the first microstructures. Further preferably, when the security element is tilted and/or bent and/or rotated a sequence of image elements which produce a 3D movement effect, a 3D morphing effect and/or a 3D flip effect is provided by the first microstructures. The sequence of the image elements here is preferably produced by the movement of the image points along the tracks when the security element is tilted and/or bent and/or rotated, as already stated above.

The image points generated by the first microstructures can have different shapes. These image points preferably have a circular disk or elliptical shape.

The dimensions of the individual image points here are preferably chosen such that the image points can be perceived with the naked human eye. The lateral dimensions of the image points here preferably lie in the range between 200 μm and 500 μm, further preferably between 200 μm and 300 μm. However, it is further also possible for the lateral dimensions of the image points to lie below the resolution capacity of the human eye, whereby a particular high resolution of the image elements can be achieved. The lateral dimensions of the image points in this case preferably lie between 20 μm and 200 μm, further preferably between 75 μm and 200 μm. The size of the image points perceived by the naked human eye can deviate from the actual size of the image points. For example, a brightly luminescent image point can be perceived to be larger. In particular, image points the actual size of which lies below the resolution capacity of the naked human eye are thereby perceptible. Here, at least one of the lateral dimensions of the image points is preferably determined by the width of the respective tracks in which the first microstructure which generates the respective image point is arranged. The other lateral dimensions of the image point are preferably determined through the choice of the structure parameters of the allocated first microstructure.

Two or more of the image points can in each case be spaced apart from each other in such a way that they cannot be resolved with the naked human eye. The spacing of the image points in this case is preferably chosen to be between 5 μm and 300 μm, further preferably between 10 μm and 200 μm.

By spacing of the image points is meant here preferably the spacing of the outer edges of the image points from each other. This spacing is preferably determined by the corresponding spacing of the allocated tracks which generate the respective image point.

Further, it is also possible for the image points to be spaced apart from each other in such a way that the individual image points can be resolved with the human eye. In this case the spacing of the image points is preferably more than 300 μm, further preferably more than 500 μm.

One or more of the image elements can in each case advantageously be for example a motif, a graphically formed outline, a figurative representation, an image, a visually recognizable image, a symbol, a logo, a portrait, a pattern, an alphanumeric character, a text and/or the like.

The individual image points of the image element can particularly preferably also adopt different movement directions with respect to the tracks and/or speeds on the respective tracks if the security element is tilted and/or bent and/or rotated. In particular, a movement effect of an image element can be dependent on a rotation about an axis oriented as desired.

In particular, a transformation, in particular a morphing, preferably a flip, can provide at least one sequence of image elements detectable for an observer as a movement, transformation and/or morphing effect.

One or more tracks and/or first microstructures can preferably be arranged relative to each other in such a way that a transformation, in particular the morphing, preferably the flip, can be provided as a sequence from one image element to one or more further image elements.

In particular, a rotation and/or bending and/or tilting of the security element about any desired axis can provide a sequence of image elements detectable for an observer as a movement, and transformation and/or morphing effect. This likewise applies to 3D movement, 3D transformation and/or 3D morphing effects.

The transformation, in particular the morphing, preferably the flip, can preferably provide at least one achromatic or monochromatic movement, transformation and/or morphing effect detectable for an observer and/or movement, transformation and/or morphing effect dependent on at least one illumination and/or observation angle, along the tracks and/or first microstructures.

If the security element features for example the number 4 and the number 2, then the number 4 can turn into the number 2 and/or vice versa when the security element is tilted and/or bent and/or rotated.

Further, it is possible for the security element to comprise only one track. If the track is illuminated with a light source, preferably an image point which provides at least one movement effect, in particular at least one movement effect dependent on an illumination and/or observation angle, along the track when the security element is rotated and/or bent and/or tilted about any desired axes becomes detectable for an observer.

The security element preferably comprises a plurality of tracks, comprising a plurality of first microstructures. As already stated above, it can hereby be achieved that a number, corresponding in particular to the number of tracks, of image points which provide one or more image elements become detectable for an observer.

Further, it is also possible for the security element to be designed in order to be illuminated with a plurality of light sources. Here, a number, corresponding to the plurality of light sources, of image points which together provide one or more image elements detectable for an observer are typically provided per track and/or per first microstructure.

Further interesting optical effects can hereby be generated. Thus, in the simplest case, it is possible for the optical effects already described above to occur multiple times when illuminated with different point light sources simultaneously. Further, it is also possible here for different optically variable effects to be generated by the security element when irradiated at different angles with different point light sources, whereby further security features which can be forged only with difficulty and in particular so-called "second line" security features are provided by the security element. By a "second line" security feature is preferably meant a security feature which is recognizable and/or detectable only with an aid. The necessary aids are usual and widespread technical devices such as for example a magnifying glass or a UV lamp (UV=ultraviolet).

By a track is meant in particular a flat area with a width, preferably with a constant width, which follows a curve curved at least in sections, preferably an elliptical, circular, spiral and/or circular arc-shaped curve, wherein the curve can in particular be open or closed, in particular a partial area of a closed curve. In a further advantageous design, the track and/or one or more contours of the track follows a curve curved on one side, with the result that preferably the sign of the curvature is the same everywhere, with the result that in particular the curvature of at least one curve does not change its sign.

By a curvature is meant in particular a local deviation of a curve from a straight line. By the curvature of a curve is meant in particular one change in direction per length and/or stretch passed through of a sufficiently short curve piece or curve progression. The curvature of a straight line is equal to zero everywhere. A circle with a radius r has the same curvature everywhere, namely 1/r. In the case of most curves, the curvature changes from curve point to curve point, in particular the curvature changes continuously from curve point to curve point, with the result that the curves in particular have no kinks and/or points of discontinuity. The curvature of a curve at a point P thus indicates how much the curve deviates from a straight line in the immediate surroundings of the point P. The amount of the curvature is called the radius of curvature and this corresponds to the inverse value of the amount of a local radius vector. The radius of curvature is the radius of the circle which represents the best approximation in the local surroundings of the contact and/or tangential point P of a curve.

The curvature progression of two or more tracks, in particular circle tracks or circular tracks and/or elliptical tracks, can be identical. In particular preferably two or more tracks, further preferably circle tracks or circular tracks and/or elliptical tracks, comprising in each case one or more first microstructures can have different curvature progressions, wherein in particular a distinctive 3D effect, further preferably a 3D effect combined with a strong achromatic movement effect, can be provided, wherein the two or more tracks, preferably circle tracks or circular tracks and/or elliptical tracks, comprising in each case one or more first microstructures can in particular be spaced apart from each other.

The width of one or more of the tracks advantageously lies between 3 μm and 300 μm, preferably between 10 μm and 100 μm.

Here, it is further also possible for the width of one or more tracks to change in each case depending on a progression direction of the respective track. The width preferably changes here continuously and/or discontinuously along the progression direction of the respective track in each case at least in sections. The width of the respective track here is preferably determined by the distance between the longitudinal edges of the respective track.

Furthermore, at least 50%, preferably 70%, particularly preferably 90% of all tracks of a plurality of tracks can in each case form at least one fifth, preferably at least one quarter, particularly preferably one third, in particular preferably half of a closed track.

In a further particularly advantageous embodiment of the invention, at least 50%, preferably 70%, particularly preferably 90% of all tracks of a plurality of tracks can in each case form at least a quarter-circle, preferably at least a third of a circle, particularly preferably a semi-circle.

The curvature of one or more of the tracks is advantageously in each case between 0.02 $mm^{-1}$ and 2 $mm^{-1}$, preferably between 0.1 $mm^{-1}$ and 1 $mm^{-1}$, or the radius lies between 0.5 mm and 50 mm, in particular between 1 mm and 10 mm.

Further preferably, one or more of the tracks can have the same, in particular the identical, curvature everywhere, in particular at every location on the respective track, further preferably at every point on the respective track.

Preferably, the curvature progressions of two or more tracks, in particular of all tracks, further preferably of all circular and/or elliptical tracks, are identical in each case. Further, it is also possible for one or more of the tracks, in particular all tracks, further preferably all circular and/or elliptical tracks, to have in each case different curvature progressions from each other.

In all of these embodiments it is particularly preferred that the curvature of one or more of the tracks, in particular of all tracks, does not change its sign over the entire progression of the respective tracks.

Further, it is also possible for the radius and/or the curvature and/or the radius of curvature of one or more of the tracks to change in each case depending on a progression direction of the respective track. Preferably, this change is continuous or discontinuous along the progression direction of the respective track in each case at least in sections. Further, the width of one or more of the tracks is in each case smaller than the radius or the radii of the respective tracks and/or in each case smaller than the or the radii of curvature of the respective track.

An allocated first microstructure is preferably provided in each of the tracks or in each of the sections of a track. Here the entire area of surface of the respective track or of the respective section is preferably covered with the allocated first microstructure. Further, the allocated first microstructure is preferably not provided outside the area of surface of the respective track or of the respective section of a track.

The allocated first microstructure preferably runs along the allocated track or the allocated section of a track. This means that at least one structure parameter of the allocated first microstructure changes depending on a parameter of the track, in particular the local tangential alignment and/or width of the track, and in particular the longitudinal extent of the structure elements of the first microstructure has a constant angle relative to the tangential alignment of the allocated track.

Thus at least one alignment, longitudinal extent and/or preferred direction of the first microstructure and/or of the structure elements of the first microstructure in each case preferably follows the allocated track or the contour of the allocated track. Here, the alignment, longitudinal extent and/or preferred direction of the microstructure is preferably oriented parallel to the progression direction of the track and/or the contour of the track at every location on the track and/or encloses a predefined offset angle therewith.

The local alignment of one or more structure parameters of the basic first microstructure is thus preferably aligned with the respectively local tangential alignment of the respective track. In particular preferably, the local tangential alignment of one or more structure parameters of one or more of the first microstructures can have the same angle relative to a local radius of curvature vector as the respective track, wherein "local" refers to the same location, in particular the same point, on the respective track at which the local alignment and the local radius of curvature vector are observed.

The detailed procedure with respect to the selection of different microstructures that can be used as first microstructure will be explained later, in the corresponding specification of this microstructure.

The security element can further preferably have one or more second microstructures, which provide a second item of optical information. In particular, the second item of optical information can be optically variable.

The one or more second microstructures are preferably in each case provided in an area of surface which does not overlap with the tracks.

The areas of surface in which the one or more second microstructures are provided are preferably formed in the form of a pattern, in particular as an alphanumeric character, pattern, as a graphic motif or as a portrait.

Further, the second microstructures can be provided in an area of surface which consists of two or more partial areas spaced apart from each other in each case, which are formed striped in each case, in particular with a width smaller than 300 μm. One or more of the partial areas can in each case overlap an allocated interruption area of the one or more tracks at least in areas.

Furthermore, in particular, one or more of the second microstructure elements of the respective one or more second microstructures can in each case be formed as one or more relief structures, in particular as one or more surface reliefs, preferably as one or more oval or round lenses, further preferably as one or more freeform surfaces with one or more lens effects, in particular preferably as one or more freely and/or circularly formed Fresnel lenses.

One or more of the second microstructures preferably provide a three-dimensionally appearing relief image, in particular a three-dimensionally achromatically appearing relief image. For this, the respective second microstructures preferably have a plurality of second facet faces, the progression and/or angle of inclination progression of which is determined in such a way that the relief image is provided by reflection and/or diffraction of the incident light.

Further, one or more or all of the first or of the first and second microstructures are preferably formed as a volume hologram or combined with an HRI reflective layer (HRI=High Refractive Index), or a metallic layer or a layer bringing about a color shift effect or a multilayer system bringing about a color shift effect.

With respect to the microstructures used, the following is revealed in particular:

One or more of the first and/or second microstructures can be converted into a volume hologram in each case by holographic exposure or be molded as relief structures.

Further preferably, one or more of the first and/or second microstructures can in each case comprise a plurality of first or second microstructure elements, which are characterized in each case in particular by the parameters spacing of the microstructure elements, relief depth, relief shape, orientation of the longitudinal direction of the microstructure elements.

Further, in particular, one or more of the first and/or second microstructures can be formed as a grating, in particular as a sinusoidal or rectangular or triangular grating.

A sinusoidal grating advantageously produces in particular two equally intense diffraction images, preferably in the $-1^{st}$ and $+1^{st}$ diffraction order, wherein, however, higher diffraction orders can in particular also occur.

Particularly preferably, one or more of the first and/or second microstructures can be formed as one or more sawtooth-shaped microstructures, in particular as blazed gratings. A blazed grating advantageously diffracts incident light mainly into a first diffraction order, preferably into a $+1^{st}$ or $-1^{st}$ diffraction order. In the ideal case, only a diffraction image with high intensity, preferably with higher intensity than in the other diffraction order, is thus visible when illuminated with a single light source, in particular a point light source. Higher intensity here means that the intensity is greater in one diffraction order, for example the $-1^{st}$ diffraction order, than in another diffraction order, for example the $+1^{st}$ diffraction order, in particular at least by a factor of 2, preferably a factor of 3.

Advantageously, preferably one or more of the first microstructures, in particular of the blazed gratings, can be overlaid with in each case at least one finer structure, for example a sub-wavelength grating, wherein the achromatic diffraction of the first microstructures preferably becomes monochromatic. In order to achieve the above effect, in particular an overlaying with high-frequency sub-wavelength cross gratings can be effected.

The periods, in particular grating periods, or the spacing of the microstructure elements of one or more of the first and/or second microstructure elements advantageously lie between 0.2 μm and 50 μm, preferably between 0.3 μm and 20 μm, particularly preferably between 2 μm and 10 μm.

The depth, in particular the relief depth, of one or more of the first or second microstructures typically lies between 50 nm and 15 μm, advantageously in each case between 50 nm and 5000 nm, preferably between 100 nm and 3000 nm.

Advantageously, the first or second microstructures diffract and/or scatter the incident light in a narrower angle range, in particular in an angle range between +10° and −10°, around the directly reflected light, i.e. the light of the zero diffraction order.

The relief shape of one or more of the first or second microstructure elements is preferably in each case sinusoidal, triangular, sawtooth-shaped and/or trapezoidal.

Further, one or more of the first or second microstructure elements can in each case have a linear shaping and in particular can be formed in the form of grating lines, which preferably have a triangular cross section.

In particular, one or more of the linear microstructure elements, in particular grating lines, can in each case have a length of between 50 μm and 100 mm, preferably between 0.5 mm and 50 mm, and in particular between 2 mm and 20 mm and/or the length of one or more of the linear microstructure elements, in particular the grating lines, can be at least 5 times and preferably 10 times greater than the grating period and/or the spacing of the respective linear microstructure element, in particular of the respective grating line from the respective neighboring grating line.

Preferably, one or more of the first or second microstructures can in each case be formed as one or more anisotropically scattering structures, in particular as anisotropic matte structures, which have a greater scattering capacity and/or a greater scattering angle for the incident light when observed along a preferred direction compared with observation in a direction transverse and/or perpendicular to the preferred direction. The average distance of one or more of the first microstructure elements of the one or more anisotropically scattering structures is in each case between 0.5 μm and 10 μm, particularly preferably between 0.8 μm and 5 μm.

The average distance of a structure is defined as the average value of the distances between neighboring local maxima and/or local minima of a structure, in particular a respective matte structure.

Particularly preferably, in each case at least three, preferably at least five, grating periods of one or more of the first microstructures and/or in each case at least three, preferably at least five, average distances of one or more of the first microstructures can be arranged in the respective one or more tracks.

Further, one or more of the first and/or second microstructure elements of the first or second microstructure in each case have at least one first or second facet face, which preferably forms one or more predominantly refractively acting microstructures, for example micromirrors. The first or second facet faces in each case have a minimum surface area dimension of between 10 $\mu m^2$ and 5000 $\mu m^2$, in particular between 25 $\mu m^2$ and 900 $\mu m^2$. Furthermore, the first or second facet faces preferably have in each case an angle of inclination relative to the surface normal of the security element of between 1° and 45°, in particular between 1° and 20°. The first or second facet faces preferably have a smooth surface or a convex or concavely curved surface.

One or more of the second microstructure elements consisting of first or second facet faces preferably represent at least one, preferably achromatic, three-dimensional representation of a relief image. Preferably, the angle of inclination of the first or second facet faces here preferably in each case lies between 1° and 45°, in particular between 1° and 20°. Preferably, the period and/or the inclination of one or more of the first or second facet faces here changes continuously in each case along one or more lateral dimensions.

Preferably, one or more structure parameters of one or more of the microstructure elements of the first microstructure can in each case change continuously and/or constantly along the respective one or more tracks, wherein one or more of the structure parameters can preferably be selected in each case from: spacing of the first microstructure elements, relief depth, orientation of the longitudinal direction of the first microstructure elements, preferred direction, average distance between the first microstructure elements, angle of inclination of the first facets.

Further, the orientation of one or more first microstructure elements of the respective first microstructure and/or the preferred direction and/or the angle of inclination of one or more first facets of the respective first microstructure can preferably in each case follow one or more contours of the respective track, which are determined in particular in each case by one of the longitudinal edges of the respective track or in each case by the centroid line of the respective track.

In particular, at least in a partial area of one or more of the tracks the local orientation of one or more first microstructure elements of the respective first microstructure or the local preferred direction of one or more first facets of the respective first microstructure can in each case correspond to the local curvature of the respective track, which can be determined in particular by one or more of the longitudinal edges of the respective one or more tracks and/or by the one or more centroid lines of the respective one or more tracks.

Preferably, at least in a partial area of one or more of the tracks the local orientation of one or more first microstructure elements of the respective first microstructure or the local preferred direction of one or more first facets of the respective first microstructure can in each case differ from the local curvature of the respective track by not more than 0° to 30°, wherein the local curvature can be determined in particular by one or more longitudinal edges of the respective track or by one or more centroid lines of the respective track.

Preferably, at least in a partial area of one or more of the tracks the local orientation of one or more first microstructure elements of the respective first microstructure or the local preferred direction of one or more of the first facets of the respective one of the first microstructure can in each case differ from the local curvature of the respective track by a predefined angle of deviation up to a maximum of ±30°, wherein the local curvature can be determined in particular by one or more longitudinal edges of the respective track or by one or more centroid lines of the respective track.

Preferably, at least in a partial area of one or more of the tracks the local orientation of one or more first microstructure elements of the respective first microstructure or the local preferred direction of one or more facets of the respective first microstructure can in each case have an angle relative to the local curvature of the respective track of between −45° and +45°, preferably an angle of between −30° and +30°, further preferably an angle of between −15° and +15°, wherein the local curvature can be determined in particular by one or more longitudinal edges of the respective track or by one or more centroid lines of the respective track.

Preferably, at least in a partial area of one or more of the tracks the longitudinal extent of one or more first microstructure elements of the respective first microstructure and/or the preferred direction can in each case run parallel or perpendicular to the respective track, relative to the plane spanned perpendicular to the surface normal of the security element, in particular in each case run parallel or perpendicular to one or more longitudinal edges of the respective track or one or more centroid lines of the respective track.

Preferably, the above-mentioned partial area of the one or more of the tracks here comprises in each case at least 50% of the respective track, particularly preferably at least 70% of the respective track, in particular preferably at least 85% of the respective track. It is hereby achieved in particular that when such a security element is illuminated by at least one radiation source, in particular a light source, preferably a point light source, only one point and/or one location on the respective track scatters and/or diffracts and/or reflects light, with the result that an image element provided thereby, in particular at least one image point, provides at least one movement effect in the case of at least one tilt and/or bend and/or rotation of the security element containing the track to the left and/or to the right and/or forwards and/or backwards, in particular about any desired axis.

Further, one or more of the tracks and/or one or more of the first microstructures can intersect in one or more intersection areas, wherein one or more of the tracks can intersect in each case once or twice or more times and/or one or more of the tracks can intersect in pairs at different frequencies. Thus, the track pairs B1 and B2, B2 and B3, as well as B1 and B3, in each case selected from a quantity of three tracks B1, B2 and B3, can in each case intersect at different frequencies from each other.

For example, a number of three closed and/or open tracks B1, B2 and B3 can intersect in such a way that the tracks B1 and B2 intersect twice, the tracks B1 and B3 intersect four times and the tracks B2 and B3 intersect only once.

One track can also intersect itself. Preferably, the tracks do not intersect themselves.

Here it can be provided that in one or more of the intersection areas in each case exclusively the first microstructure or the first microstructures of a track intersecting in the respective intersection area are provided. The first microstructure or the first microstructures of the other intersecting tracks are then not provided in this intersection area.

Further, however, it is also possible for in each case first microstructures of two or more, in particular of all, tracks intersecting in the intersection area to be provided in one or more of the intersection areas. Here, it is preferred that the first microstructure or the first microstructures of the intersecting tracks are provided in a one- or two-dimensional grid, wherein the grid width is in particular between 10 μm and 300 μm.

This gridding of different first microstructures is called a mosaic surface in the following.

Due to such mosaic surfaces, in each case interruptions in movement effects, in particular in optical movement effects, of the respective track, in particular with respect to a security element of which the tracks does not have any mosaic surfaces, can be prevented or at least made optically less striking.

In the mosaic surface every track and/or first microstructure running through an intersection area can advantageously be allocated an identical proportion of the surface area of the intersection area, with the result that in the intersection area every track is provided with the same proportion, in particular proportion of surface.

If, for example, two tracks and/or two first microstructures intersect, each of the two tracks and/or of the two first microstructures in the intersection area is preferably allocated a surface area, in particular a proportion of surface of 50% of the surface area of the intersection area. Thus, each of three, generally n, intersecting tracks and/or first microstructures can be allocated a proportion of surface of in each case one third, generally 1/n, of the intersection area.

Further, it is also possible for one or more areas of surface which are provided with one of the first microstructures of the tracks intersecting in the respective intersection area to be provided outside one or more of the tracks in the area of one or more of the intersection areas. The one or more areas of surface here are arranged preferably less than 150 μm, further preferably less than 50 μm, away from the respective intersection area. This distance is determined by the distance between the closest outer edges of the intersection area and/or of the tracks intersecting in the intersection area and the closest outer edge of the respective area of surface.

Through such a design this can effectively increase the existing surface area for the first microstructures of the intersecting tracks in the intersection area without negatively influencing the optical appearance. Interruptions in sequences of movement, morphing and/or flip effects, which are provided by the tracks intersecting in the respective intersection area, can hereby be prevented or at least made optically less striking.

Further preferably, at least one of the tracks and/or at least one of the first microstructures can have at least one interruption.

Here, the first microstructure or the first microstructures of the respective tracks are preferably not provided or not continued in the area of the interruptions.

The interruptions make it possible to improve an overlaying of effects provided by the first microstructures with further optical effects of the security element and thus to further increase the protection against forgery of the security element.

The interruptions of the tracks preferably have dimensions with respect to their extent in the longitudinal direction of the respective tracks below the resolution capacity of the human eye, and preferably have a lateral extent in this direction of between 0.5 μm and 200 μm, further preferably between 1 μm and 100 μm.

At least one interruption of at least one track and/or of at least one first microstructure can preferably be present in at least one intersection area of two or more tracks and/or two or more first microstructures.

Further, it is preferred that at least one interruption of at least one track and/or of at least one first microstructure are present outside an intersection area of two or more tracks and/or two or more first microstructures.

The interruptions are preferably randomly and/or pseudo-randomly distributed. In particular, one or more of the interruptions can in each case be randomly and/or pseudo-randomly distributed parallel and/or perpendicular to one or more tangent vectors of the respective track.

Further, it is possible for at least one track and/or at least one first microstructure to have at least one offset. An offset is present when two parts and/or partial areas and/or sections of at least one track and/or one first microstructure are arranged offset relative to each other, in particular shifted relative to each other, wherein the size of the displacement, in particular shift, can be as large as desired.

In particular, one or more of the lateral dimensions of an offset can in each case be smaller than the width of the respective track.

Preferably, at least one track and/or one first microstructure can have at least one offset, wherein the at least one offset can in particular be randomly and/or pseudo-randomly distributed over the arc length, preferably a part of the arc length, of the at least one track and/or one first microstructure. Further preferably, the offsets, in particular the size of the displacement and/or the shift, can be randomly and/or pseudo-randomly distributed. In particular, one or more of the offsets can in each case be randomly and/or pseudo-randomly distributed parallel and/or perpendicular to one or more tangent vectors of the respective track.

Such an offset can be provided by at least one cut, in particular at least one straight cut, through at least one track and/or one first microstructure and the subsequent shift of the at least one track and/or first microstructure cut in such a way relative to the track and/or first microstructure.

Further preferably, the angle of the at least one cut, in particular the at least one cut angle, can be aligned as desired, in particular as desired relative to an alignment and/or relative to a longitudinal extent of the at least one cut track and/or first microstructure, with the result that the at least one track and/or first microstructure cut by at least one cut and the at least one track and/or first microstructure do not merge into each other flush.

Further, neighboring parts of a cut of at least one cut track and/or one first microstructure, in particular perpendicular to an alignment and/or to a longitudinal extent of the at least one track and/or first microstructure, can be arranged shifted relative to each other.

Preferably, an offset can provide a reduction in an undesired chromatic diffraction, with the result that in particular an improved achromatic appearance and thus an improved sequence of image elements can be provided.

Particularly preferably, a partial area and/or a section of a track and/or of a first microstructure can be offset by two identically aligned cuts, in particular by two cuts aligned as desired relative to each other, further preferably by two cuts aligned parallel to each other, at different locations, in particular positions, on the track and/or the first microstructure, and a shift and/or displacement of the partial area of the track and/or first microstructure cut out in such a way, relative to the uncut track and/or first microstructure, in order to generate in particular an offset of a partial area and/or section of a track and/or first microstructure.

Further preferably, at least the offset, in particular the size of the displacement and/or of the shift, can be less than a width of a track and/or of a first microstructure. Furthermore, an offset, in particular the size of the displacement and/or of the shift, can correspond to the width of a track. Further preferably, the offset, in particular the size of the displacement and/or of the shift, is not more than five times the width of a track and/or of a first microstructure, wherein in particular jumps in the actions of movement, morphing and/or flip effects, preferably of one or more image elements, of the first microstructures can thus be prevented. Particularly preferably, an offset, in particular the size of the displacement and/or of the shift, is on average between 1% and 50%, preferably between 2% and 20%, of the width of one or more tracks and/or first microstructures.

In a first step of a preferred method for producing the tracks and/or the first microstructures, a file which comprises one or more locational arrangements of image points of one or more image elements is provided. Preferably, in a further step, one or more tracks which are curved at least in sections and/or one or more sections of one or more tracks which are curved at least in sections are determined from the locational arrangement of the image points. Furthermore, in particular, in a next step, in the one or more tracks or sections of tracks in each case one or more first microstructures are provided which, when illuminated, provide a first item of optically variable information, in particular provide one or more 3D effects and/or movement effects when the security element is tilted and/or bent and/or rotated, preferably provide achromatic or monochromatic 3D effects and/or movement effects. The tracks with the microstructures can be created in a master substrate for example by means of electron-beam lithography or laser lithography. The structures of such a master substrate can then be copied into a metal substrate, in particular made of nickel, in a galvanic process. By duplication of the metal substrate, corresponding replication molds are preferably obtained which allow mass production of microstructures, for example by means of roll-to-roll replication methods.

Preferably, in the file, a sequence of the image elements can be defined in order to be able to determine the tracks and/or track sections in such a way that the desired sequence of the image elements is produced by the movement of the image points along the tracks when the security element is tilted and/or bent and/or rotated.

Preferably, in the file, a sequence of image elements can be defined, with the result that from an unrecognizable image, for example a randomly or pseudo-random arranged arrangement of points and/or a cloud-like distribution of points, a recognizable image, for example a denomination, is produced by the movement of the image points along the tracks when the security element is tilted and/or bent and/or rotated.

The first and/or second microstructures are preferably molded into the same or also into two different layers of the security element by means of a replication method. These layers are preferably varnish layers, which have a layer thickness preferably in the range between 1 μm and 10 μm. Further, it is also possible for these layers to be a carrier film of the security element, in particular a PET film.

One or more further layers, which lie above the replication layer from the visible face of the carrier film, can be color layers, in particular opaque, translucent or transparent color layers. These color layers are preferably applied or formed patterned. Alternatively, the replication layer can also be a translucent or transparent color layer.

Another one or more further layers can be arranged on the carrier film of the security element, wherein in particular one or more of the further layers are selected from: detachment layer, protective layer, bonding layer, anti-adhesive layer, barrier layer, adhesive layer.

The one or more layers of the security element, in which the first and/or second microstructures are molded, are further preferably coated with one or more reflective layers, which cover the one or more first and/or second microstructures in each case at least in areas. These reflective layers are preferably metallic reflective layers, for example made of aluminum (Al), copper (Cu) or silver (Ag), and/or highly refractive layers, so-called HRI layers, for example $TiO_2$ or ZnS.

Further, the one or more layers of the security element, in which the one or more first and/or second relief structures are molded, can also be coated or printed with one or more color layers, in particular translucent or transparent color layers. These color layers are preferably applied or formed patterned. They preferably have different colors. Further, the one or more layers, in which the first and/or second microstructures are molded, can in each case be coated or printed with one or more inks and/or layers that change depending on the observation angle, for example coated with cholesteric liquid crystal layers and/or with layers containing color-change pigments. In particular, layers generating the color changes can consist of an interference layer system. For example, this interference layer system can be a three-layered system consisting of a semi-transparent absorber layer, a dielectric spacer layer and a semi-transparent or opaque mirror layer.

The above-mentioned coatings can be combined with each other in any desired form, thus for example several of the above-mentioned coatings can follow one another on one or both sides of a layers provided with one or more of the first and/or second relief structures, and they can in particular also be formed patterned in each case. Interesting optical effects, in particular color effects, can hereby be achieved, which further improve the protection against forgery of the security element.

BRIEF DESCRIPTION OF THE DRAWINGS

In the following the invention is explained by way of example with reference to several embodiment examples utilizing the attached drawings. There are shown in.

DETAILED DESCRIPTION OF THE PREFERRED EMBODIMENTS

FIGS. 1*a* to 1*e* illustrate by way of example the structure of a security document 5 with a security element 1.

Figure 1A:
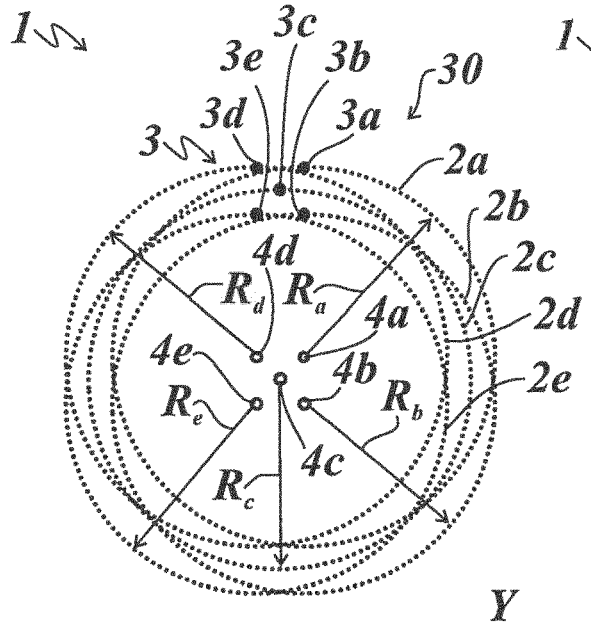
FIGS. 1*a*, 1*b*, 1*c*, 1 *d*, 1*e*: schematic representations of a security element with several tracks
Figure 1B:
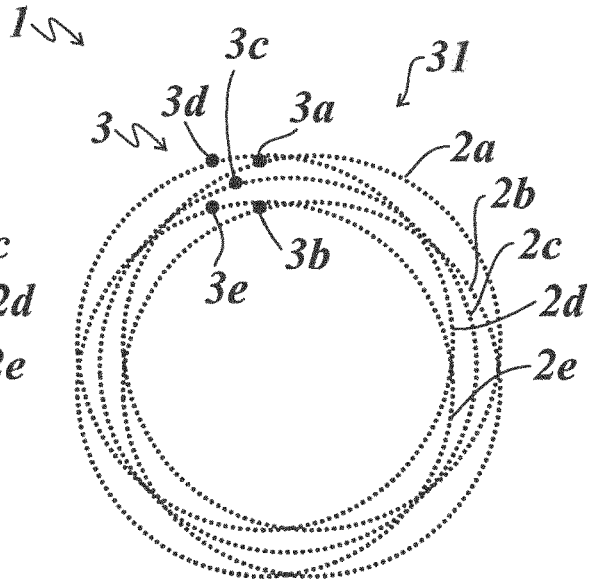
Figure 1C:
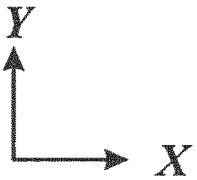
Figure 1C:
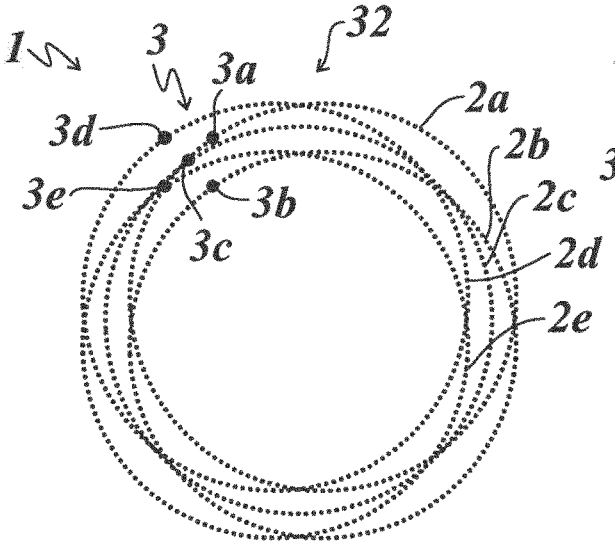
Figure 1D:
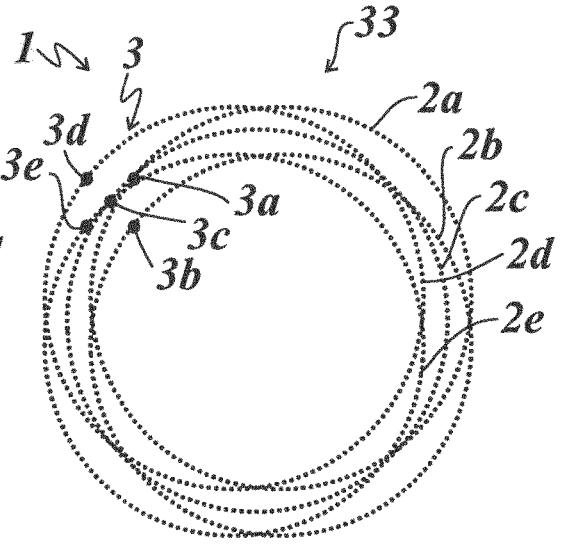
Figure 1E:
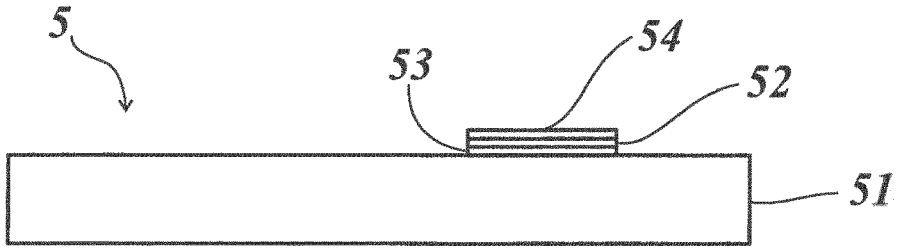

FIGS. 1*a* to 1*d* show the security element 1 in a top view and FIG. 1*e* shows it in cross section applied to a document body, or to a security document 5.

The security document 5 preferably consists of an ID document, for example a passport, a passport card, a visa or an access card. However, it can also be a further security document 5, for example a banknote, a security or a credit card or bank card.

The security document 5 has a document body 51 and one or more security elements, of which the security element 1 is shown in FIGS. 1*a* to 1 *e*.

Here, the security elements can be applied to the document body 51 of the security document 5, or embedded in the document body 51 of the security document 5, in particular completely or partially embedded.

The document body 51 of the security document is preferably formed multi-ply and in particular comprises a carrier substrate which is formed by a paper substrate and/or plastic substrate. Further, the document body 51 can comprise another one or more protective layers, one or more decorative layers and/or one or more security features. Further, the document body 51 can have still further layers, for example one or more detachment layers, bonding layers, anti-adhesive layers, barrier layers and/or adhesive layers. Here, the document body 51 preferably also comprises an electronic circuit, in particular an RFID chip, in which items of information are stored.

The document body 51 can have a window area, wherein the window area can be formed as a through-hole in the document body 51 and/or as a transparent area of the document body 51. The security element 1 can be arranged overlapping with the window area and can thus be visible from both sides of the security document 5.

The security element 1 is formed in particular by the transfer ply of a transfer film, by a laminating film and/or by a film element, in particular in the form of a security patch or in the form of a security strip or in the form of a security thread. The security element 1 can here cover a surface of the security document 5 over the whole surface and/or only partially, for example can be formed in strip or patch form, as shown with respect to the security element 1 in FIG. 1*e*.

Here, the security element 1 preferably has a protective layer 54, a decorative layer 52 and an adhesive or adhesion-promoting layer 53. Thus, for example, the security element 1 is formed in the form of the transfer ply of a transfer film, which comprises a protective layer 54, a decorative layer 52 and an adhesive layer 53 and is applied to the front side of the document body 51, as shown in FIG. 1*e*.

The decorative layers 52 of the security element 1 forms one or more security features, which are preferably also optically visible for the human observer.

Thus, the decorative layers 52 have for example one or more of the following layers:

The decorative layer 52 has one or more layers, which in each case have one or more first and/or second microstructures.

Here, the one or more first or second microstructures can be converted into a volume hologram in the respective layer by holographic exposure. However, they can also be formed as a relief structure, which is molded into a surface of the respective layer. These layers are thus preferably a layer of a photopolymer, in which areas with different refractive indices are provided for the generation of a volume hologram, or a varnish layer or plastic film, into which the surface relief of the microstructure is molded by a replication method.

The microstructures are preferably diffractive structures, such as for example rectangular diffraction gratings, sinusoidal diffraction gratings or also zero-order diffraction structures. The microstructures can also be isotropic and/or anisotropic matte structures, triangular blazed gratings and/or structures with substantially reflective action, such as microlenses, microprisms or micromirrors.

The one or more first microstructures are preferably provided in one or more tracks which are curved at least in sections, of which several tracks 2*a* to 2*e* are shown in the figures FIG. 1*a* to FIG. 1*d*. Further, it is also possible for one or more of the first microstructures to be provided in one or more sections of a track which are curved at least in sections, for example sections of the tracks shown in FIGS. 1*a* to 1 *d*. Further, it is possible for one or more of the first microstructures to run in each case along one or more tracks which are curved at least in sections or to run along one or more sections of a track which are curved at least in sections.

The decorative layer 52 preferably has one or more metallic layers, which are preferably provided in the security element in each case not over the whole surface, but only partially. Here, the metallic layers can be formed opaque, translucent or transmissive. Here, the metallic layers are preferably formed of different metals, which have a clearly different reflection and/or transmission spectrum. For example, the metal layers are formed of aluminum, copper, chromium, gold, silver or an alloy of these metals.

Here, the one or more metal layers are preferably structured patterned, preferably formed in the form of alphanumeric characters and/or as graphics and/or as complex representations of objects.

The decorative layer 52 can further comprise one or more color layers, preferably transparent or translucent color layers. These color layers are preferably color layers which are applied by means of a printing method, and which have one or more dyes and/or pigments which are incorporated in a binder matrix.

The decorative layer 52 further preferably has one or more interference layers, which reflect or refract the incident light in a wavelength-selective manner. These layers can be formed for example of thin-film elements which generate a color shift effect dependent on the angle of view, based on an arrangement of layers which have an optical depth in the region of a half or a quarter wavelength of the incident light. These layers typically comprise a dielectric spacer layer, in particular arranged between a semi-transparent absorber layer and a semi-transparent or opaque mirror or reflective layer or can preferably be formed of a layer comprising thin-film pigments.

The decorative layer 52 can further preferably have one or more liquid crystal layers, which generate for one thing a polarization of the incident light and for another a wavelength-selective reflection and/or transmission of the incident light depending on the alignment of the liquid crystals.

FIG. 1*a* shows a detail of the security element 1 comprising the curved tracks 2*a*, 2*b*, 2*c*, 2*d*, 2*e* offset relative to each other, wherein the tracks have the radii $R_a$, $R_b$, $R_c$, $R_d$, $R_e$. The center points 4*a*, 4*b*, 4*c*, 4*d*, 4*e* of the tracks are arranged in the geometric centers of the tracks 2*a*, 2*b*, 2*c*, 2*d*, 2*e* and are respectively spaced apart from all points on the circular tracks 2*a*, 2*b*, 2*c*, 2*d*, 2*e* with the radii $R_a$, $R_b$, $R_c$, $R_d$, $R_e$, with the result that the curvature of the tracks 2*a*, 2*b*, 2*c*, 2*d*, 2*e* is respectively in each case $1/R_a$, $1/R_b$, $1/R_c$, $1/R_d$, $1/R_e$. The plane in which the tracks lie, or have a spatial extent, is spanned by a two-dimensional coordinate system which is described by the base vectors x and y, wherein the vectors x and y are preferably perpendicular to each other, as shown in FIG. 1*a*.

However, in particular, coordinate systems with more than two dimensions and/or coordinate systems on at least one curved track can also be chosen.

FIGS. 1*a* to 1 *d* show the case where all tracks have the same radius. Further preferably, the radii of the tracks 2*a* to 2*e* can also differ from each other. Further, at least one of the tracks 2*a* to 2*e* can have a variable curvature progression, preferably when the track is not formed circular but is formed for example elliptical and/or spiral and/or in a circular arc. The tracks 2*a* to 2*e* can further preferably be continuous and/or differentiable and/or integrable curves, wherein the tracks 2*a* to 2*e* can be not strictly one-dimensional curves, but preferably also two-dimensional curves, such as for example a partial area of a surface of a sphere.

The tracks 2*a* to 2*e* can particularly preferably also be formed as closed tracks and/or from at least one partial area of a closed track. In particular, at least 50%, preferably 70%, particularly preferably 90% of all tracks can in particular in each case form at least one fifth, preferably at least one quarter, particularly preferably at least one third, in particular preferably at least half of a closed track. Further, in particular at least 50%, preferably 70%, particularly preferably 90% of all tracks can in particular in each case form at least a quarter-circle, preferably at least a third of a circle, particularly preferably a semi-circle.

The tracks 2*a*, 2*b*, 2*c*, 2*d*, 2*e* in FIGS. 1*a* to 1*d* are designed as two-dimensional circular curved curves and represented as dotted lines in the embodiment example shown there. The sign of the curvature of the curved tracks does not change and is constant in particular in the case of circle tracks or circular tracks. Further preferably, the curvature of a track lies between 0.02 $mm^{-1}$ and 2 $mm^{-1}$, preferably between 0.01 $mm^{-1}$ and 1 $mm^{-1}$. In particular preferably, at least one track, in particular at least one circular track, can have the same curvature everywhere. Particularly preferably, the curvature progression of all tracks 2*a* to 2*e*, in particular all circle tracks or circular tracks, can be identical, as shown in FIG. 1*a* to FIG. 1*d*. In particular preferably, the curvature progression of the tracks 2*a* to 2*e* can be different from each other.

The first microstructures, which are provided in the tracks 2*a* to 2*e*, provide a first item of optically variable information. This first item of optically variable information is a movement effect in the embodiment example according to FIGS. 1*a* to 1 *d*. Here the first item of optically variable information has one or more image elements, which is composed in each case of several image points.

The first microstructures, which are provided in the tracks 2*a* to 2*e*, generate an image element 3 which is formed in particular of an arrangement of image points 3*a*, 3*b*, 3*c*, 3*d*, 3*e* in the embodiment example according to FIGS. 1*a* to 1 *d*. Preferably, the security element 1 provides an observer with one or more image elements 3, wherein at least one image element 3 can be formed for example as a motif.

The image points 3*a*, 3*b*, 3*c*, 3*d*, 3*e* are in each case generated by the first microstructures of the tracks 2*a*, 2*b*, 2*c*, 2*d* and 2*e*. The image points 3*a*, 3*b*, 3*c*, 3*d*, 3*e* move along the respectively allocated track when the security element 1 is tilted and/or bent and/or rotated, when illuminated with at least one light source, preferably with a point light source.

The image points 3*a* to 3*e* of the image element 3 can have a punctiform, in particular circular disk-shaped form, as shown in FIGS. 1*a* to 1 *d*. However, it is also possible for them to have another shape, for example an elliptical shape.

The image element 3 in FIG. 1*a* is detectable or visible for an observer if the tracks 2*a*, 2*b*, 2*c*, 2*d*, 2*e* are irradiated by a light source, wherein the tracks are designed in such a way that only one image point per track is visible for the observer. The image points 3*a*, 3*b*, 3*c*, 3*d*, 3*e* visible in such a way provide the image element 3 through the arrangement on the tracks and the constant distances from each other.

In particular, the image element 3 can move, when observed by an observer, along the tracks 2*a*, 2*b*, 2*c*, 2*d*, 2*e*, if the security element 1, which comprises the tracks, is tilted and/or bent and/or rotated and/or inclined relative to the observer and/or the radiation source. Particularly preferably, the image element 3 moves along the tracks in each case in one of the two directions of movement possible per track, in particular degrees of freedom of movement, depending on the direction of the tilt and/or bend and/or rotation and/or inclination of the security element 1 relative to the observer.

Further preferably, the image element 3 moves as an arrangement of the five image points 3*a* to 3*e* shown in FIG. 1*a* along the five tracks 2*a*, 2*b*, 2*c*, 2*d*, 2*e*, with the result that the arrangement shown in FIG. 1*a* of the image points 3*a*, 3*b*, 3*c*, 3*d*, 3*e* relative to each other is preserved and/or the orientation with respect to the coordinate system shown in FIGS. 1*a* to 1 *d*, spanned by the vectors x and y, does not change when the security element 1 is tilted and/or bent and/or rotated.

By rotation of the security element 1 is meant here the rotation of the security element 1 about the surface normal of the security element 1, which is at right angles to the plane spanned by the vectors x and y. By tilting of the security element 1 is meant a tilting of the security element 1 about an axis which lies in the plane spanned by the vectors x and y.

Advantageously, the image element 3 can change, preferably continuously change, in particular the alignment of the image element 3 relative to an axis along and/or parallel to the vectors x and/or y of the coordinate system shown in FIGS. 1*a* to 1 *d* during a rotation and/or bending and/or tilting of the security element 1, with the result that a continuous or discontinuous movement effect is provided for the observer. Further preferably, the image element 3 can keep the alignment of the image element 3 with respect to an axis parallel to and/or along the vectors x and/or y of the coordinate system shown in FIGS. 1*a* to 1 *d* constant during a rotation and/or bending and/or tilting of the security element 1.

In FIGS. 1*a* to 1 *d* the alignment of the image element 3 relative to the coordinate system characterized by the vectors x and y is constant over the course of the movement, in particular at each of the positions 30, 31, 32, 33.

FIGS. 1*a* to 1 *d* show, in any desired sequence, a movement effect of the image element 3 comprising the five image points 3*a*, 3*b*, 3*c*, 3*d*, 3*e*, wherein the center point 30 of the image element 3 at the position of the image point 3*c* in FIG. 1*a* moves to the position 31 in FIG. 1*b*, onwards to the position 32 in FIG. 1*c* and finally to the position 33 in FIG. 1*d*. The direction of the movement of the image element 3 can preferably be chosen as desired, in order to provide different movement effects.

Figure 2A:
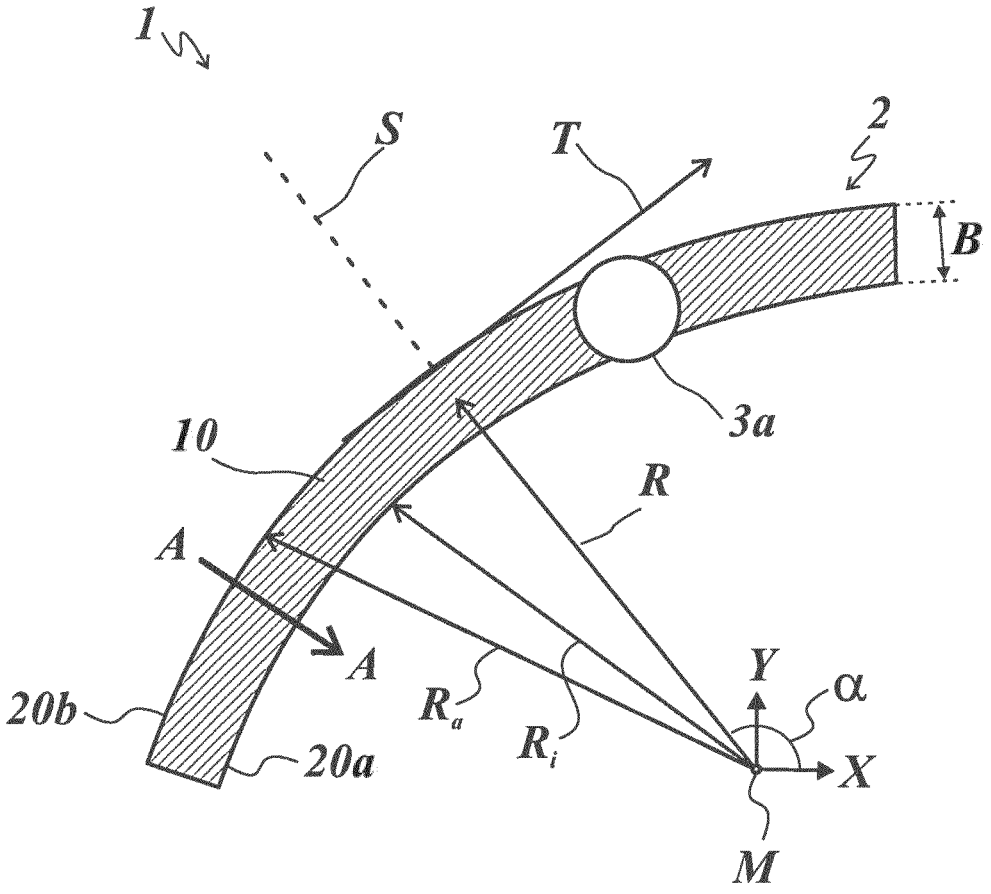
FIG. 2*a*: schematic representation of a security element

FIG. 2*a* shows a detail of the security element 1 comprising a segment 20 of a curved track 2 with a width B and the radius R. The curved track 2 can be in particular one of the tracks 2*a* to 2*e* according to FIGS. 1*a* to 1 *e*.

Further, FIG. 2*a* shows an image point 3*a*, wherein the image point 3*a* is preferably located on the track and can preferably move along the track, with the result that a movement effect, in particular a continuous movement effect, is generated for an observer. Furthermore, a cut A→A' is shown in FIG. 2*a*, which runs in particular radially relative to the center point of a closed, preferably circular and/or elliptical track, wherein the cut runs through the track in the radial direction. Further, a two-dimensional coordinate system is shown in FIG. 2*a* by two vectors x and y arranged perpendicular to each other, which spans the plane in which the track 2 lies, or is embedded.

Preferably, the track 2 can have a width B of between 2 μm and 300 μm, in particular between 5 μm and 150 μm, further preferably between 10 μm and 100 μm.

The surface area of the track is dependent on the arc length of the track and the width of the track. The width of the track can be constant or can change along the track. Preferably, the width of the track does not change with the progression of the track, in particular the progression of an azimuthal angle α with respect to the coordinate system with the base vectors x and y.

An inner contour 20*a* corresponds to an inner edge of the track 2 and/or of a partial area of a track preferably with an inner radius $R_i$. The outer contour 20*b* of the track 2 and/or of the partial area of a track corresponds to an outer edge of the track, which preferably has an outer radius $R_a$. The inner contour is arranged on the side of the track which points in the direction of the center point M of a circle, which is determined by the radius of curvature vector, while the outer contour 20*b* of the track is arranged on the side 20*a* of the track pointing away from a from the radius of curvature vector.

Further, in an extension of the radius vector R a perpendicular line S is drawn in, which is perpendicular to a tangent vector T which adapts to the outer edge of the track. The direction of the tangent vector T is aligned perpendicular to the radius vector R in the present embodiment example.

Preferably, the radius of curvature vector, in particular a local radius of curvature vector, can relate to any desired point and/or location within the surface area spanned by a track 2, wherein the amount and the angle of the radius of curvature vector can be dependent on the position on the surface area spanned by a track 2 and/or of the azimuthal angle α.

The radius of curvature vector can relate in particular also to an inner contour or edge 20*a* or outer contour or edge 20*b* of at least one track 2, wherein the amount and the angle of the radius of curvature vector can be dependent on the position on the inner and/or outer contour of a track 2 and/or of the azimuthal angle α.

The curvature of an inner contour at a particular azimuthal angle α of the track 2 and/or of the partial area of a track is preferably always greater than the curvature of an outer contour at this azimuthal angle α. The distance between a particular location and/or a particular point at a particular azimuthal angle α on an outer contour and the same location and/or the same point at the particular azimuthal angle α on an inner contour preferably corresponds to the width of the track 2, in particular the width of the track 2 dependent on the location and/or the point at the particular azimuthal angle α.

In a further preferred embodiment example the surface area of the track 2 and/or of a partial area of the track can be covered with at least one first microstructure 10. In particular, the first microstructure 10 can also follow the inner and/or the outer contour of the track 2 and/or of a partial area of the track.

Figure 2B:
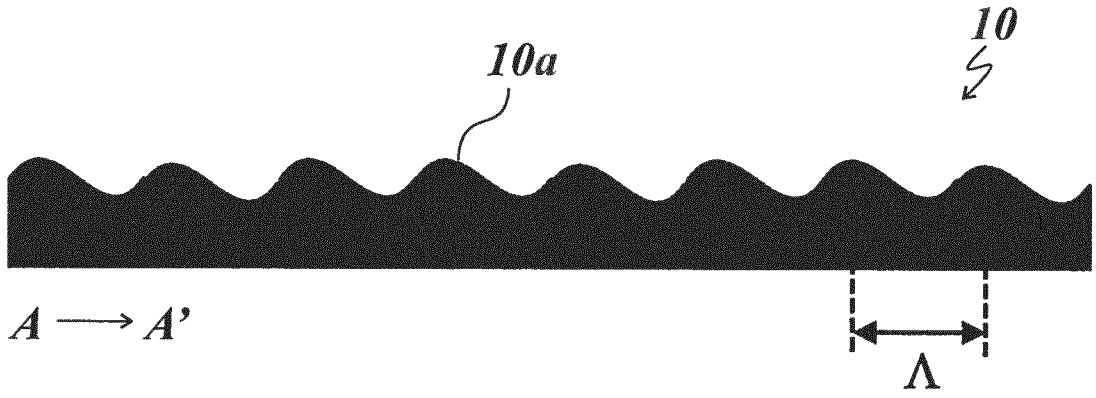
FIGS. 2*b*, 2*c*, 2*d*: schematic relief and grating structures
Figure 2C:
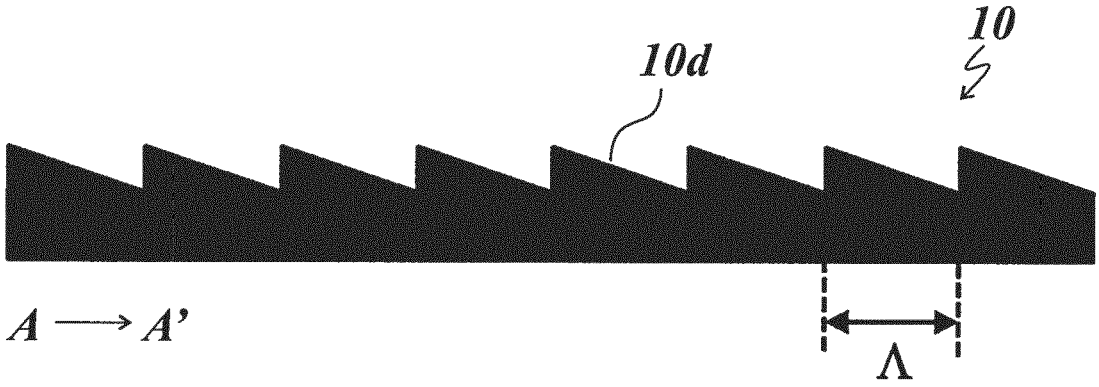
Figure 2D:
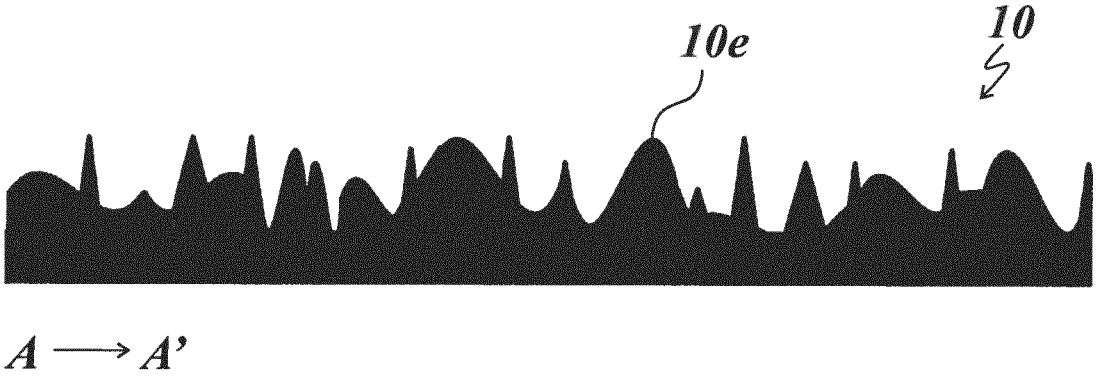

FIGS. 2*b*, 2*c* and 2*d* each show one embodiment example for at least one first microstructure 10, which can be provided for example on the track 2 shown in FIG. 2*a* and/or the partial area of a track shown in FIG. 2*a*.

In particular, FIGS. 2*b*, 2*c* and 2*d* show a cut of the first microstructures along the cut line A→A' shown in FIG. 2*a*.

FIG. 2*b* shows a grating 10*a* with a sinusoidal profile as a design of the first microstructure 10. The grating 10*a* has a plurality of successive structure elements, which are preferably spaced apart from each other periodically. The individual structure elements here preferably have a longitudinal extent much greater than the transverse extent. Thus, they preferably have a linear shaping and in particular are formed as grating lines, which have a sinusoidal cross section. The progression of these grating lines here defines the orientation of the longitudinal direction of the microstructure elements of the grating 10*a*. Alternatively, the grating lines can also have a rectangular cross section, and thus a rectangular profile, instead of the sinusoidal one.

FIG. 2*c* shows a design of the first microstructures 10 as a blazed grating 10*d*. The first microstructure can in particular also be formed as a sawtooth-shaped grating and/or triangular grating.

The blazed grating 10*d* likewise preferably consists of a sequence of microstructure elements which have in each case a triangular cross section. Here, the inclination of the two sides of the microstructure elements relative to the plane spanned by the vectors x and y preferably differs, with the result that the microstructure elements have an asymmetrical profile. The microstructure elements here further likewise have a greater, in particular much greater, longitudinal extent than transverse extent, with the result that the microstructure elements likewise form linear microstructure elements, with a triangular cross section here. The progression of the longitudinal extent of the microstructure elements here defines the longitudinal direction of the microstructure elements.

Preferably, the first microstructures 10, in particular of FIGS. 2*b* and 2*c*, have a period or grating period ∧ of between 0.2 μm and 50 μm, preferably between 0.3 μm and 20 μm, further preferably between 2 μm and 20 μm and particularly preferably between 3 μm and 10 μm, and/or a grating depth of between 50 nm and 15,000 nm, advantageously between 50 nm and 5000 nm, preferably between 100 nm and 3000 nm.

FIG. 2*d* shows a first microstructure 10, which is formed as an anisotropically matte scattering structure and/or anisotropic matte structure 10*e*. Such matte structures are characterized in that they display an asymmetrical scattering behavior and thus generate an optically variable effect. The anisotropic matte structures 10*e* here have a greater scattering capacity and/or a greater scattering angle for the incident light when observed along a preferred direction in comparison with a direction transverse and/or perpendicular to the preferred direction. The average distance between the microstructure elements of the matte structure 10*e* preferably lies in a range between 0.5 μm and 10 μm, particularly preferably between 0.8 μm and 5 μm.

Particularly preferably, at least three, preferably at least five grating periods of the first microstructures 10 and/or at least three, preferably at least five average distances between the first microstructures 10 are arranged in the at least one track 2, in particular over the width of the track 2, and/or the at least one partial area of the track, in particular the width of the partial area of the track 2.

Particularly preferably, the at least one first microstructure 10 can further also consist of an arrangement of a plurality of micromirrors, which are inclined relative to the plane spanned by the vectors x and y according to respective angles of inclination.

Further preferably, one or more of the first microstructure elements of the first microstructure 10 in each case have at least one first or second facet face, which forms in particular a micromirror. In a further embodiment example the first microstructure 10 can be formed as a lens structure, grating 10*a*, matte structure 10*e* or blazed grating 10*d* and have a combination with one or more micromirrors. Preferably, the grating 10*a* here has a sinusoidal, rectangular, sawtooth-shaped and/or triangular profile.

Figure 3:
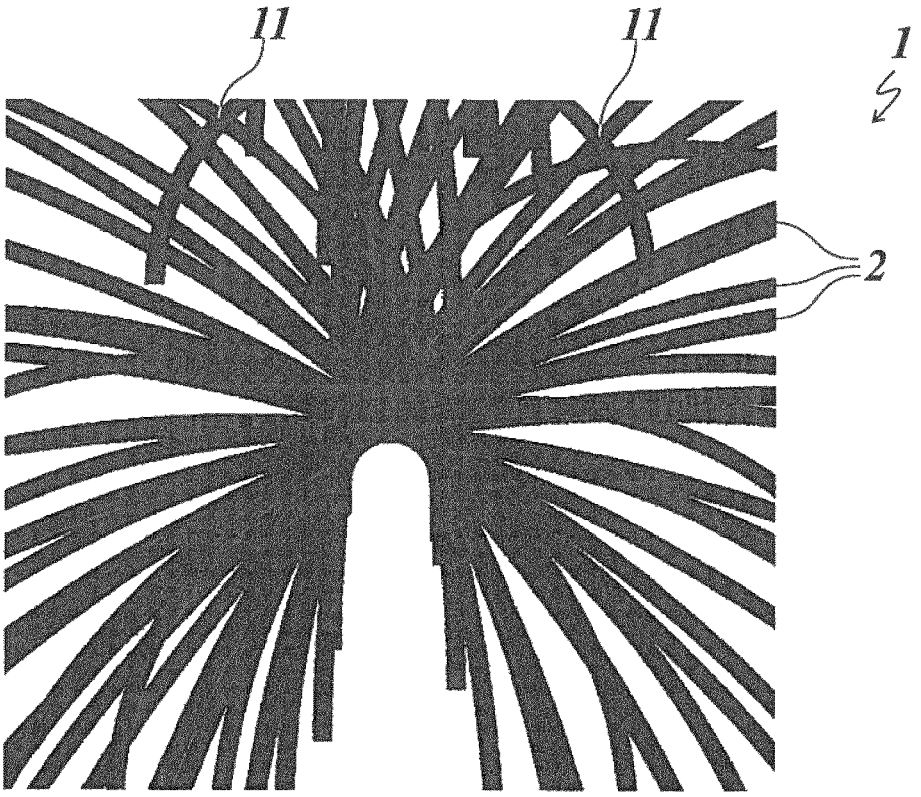
FIG. 3: schematic representation of a security element with a plurality of tracks FIG. 4 schematic representation of a security element with an intersection area FIG. 5 schematic representation of a security element with an intersection area and interruptions FIG. 6 schematic representation of a security element with an intersection area and offsets FIG. 7 schematic representation of a security element with an intersection area FIG. 8 schematic representation of a security element with an intersection area FIG. 9*a* schematic representation of the optical action of a security element FIG. 9*b* schematic representation of the optical action of a security element FIG. 10*a* schematic representation of the optical action of a security element FIG. 10*b* schematic representation of the optical action of a security element when illuminated with two light sources FIGS. 11*a*, 11 *b*, 11*c* schematic representation of the optical action of a security element FIGS. 12*a*, 12*b* schematic representation of the optical action of a security element depending on the distances between the image points

FIG. 3 shows a security element 1 comprising a plurality of curved, unclosed tracks 2 and/or partial areas of tracks, wherein tracks and/or partial areas intersect and/or overlie one another in intersection areas 11.

Figure 4:
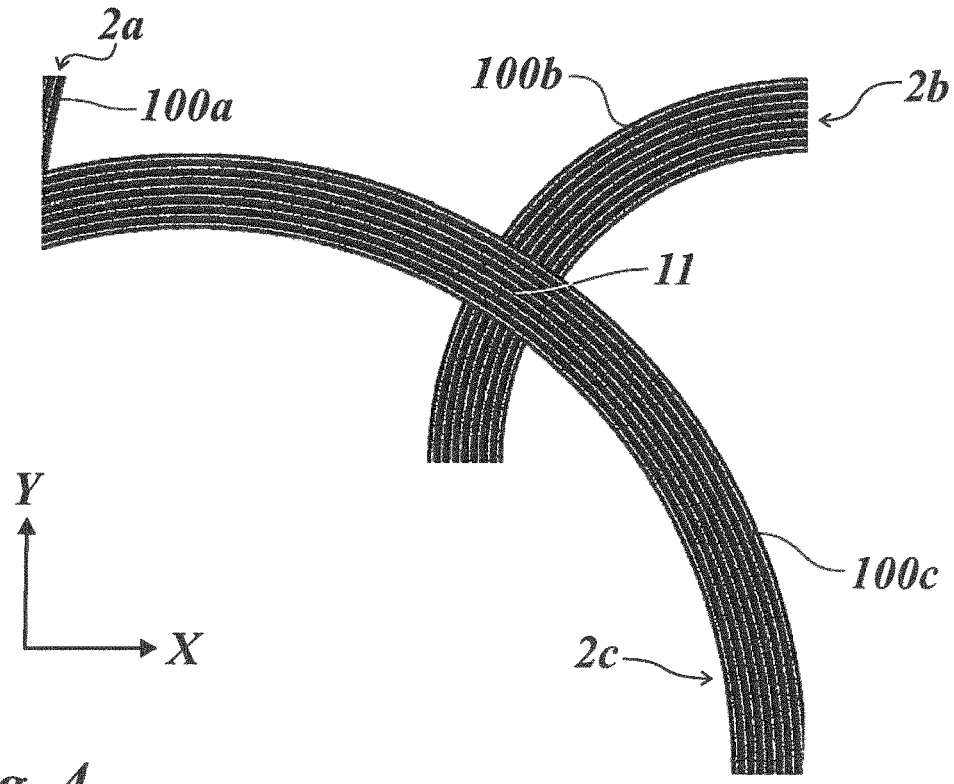

FIG. 4 shows a detail of a security element 1 comprising three curved tracks 2*a*, 2*b*, 2*c*, wherein the tracks 2*b* and 2*c* in particular intersect in an intersection area 11. Further, FIG. 4 shows first microstructures 100*a*, 100*b*, 100*c* arranged along the respective tracks 2*a*, 2*b*, 2*c*.

Preferably, the alignment of the first microstructures 100*a*, 100*b*, 100*c* and/or at least one structure parameter of the first microstructures 100*a*, 100*b*, 100*c*, in particular the spacing of the microstructure elements, the relief depth, the orientation of the longitudinal direction of the microstructure elements, the preferred direction, the average distance between the microstructure elements and/or the angle of inclination of the micromirrors, changes continuously and/or constantly along the respective track.

FIG. 4 shows by way of example the continuous change in the alignment of the longitudinal extent or the orientation of the longitudinal direction of the microstructure elements of the grating structures 100*a*, 100*b*, 100*c* along the corresponding tracks 2*a*, 2*b*, 2*c*. Thus, the longitudinal extent of the grating structures 100*a*, 100*b*, 100*c* at every location on the respective tracks 2*a*, 2*b*, 2*c* is aligned parallel to the tangential direction of the corresponding location on the respective tracks 2*a*, 2*b*, 2*c*. The grating structures in this detail of the security element 1 have a width transverse to the tracks of preferably seven grating periods.

Preferably, the alignment and/or the longitudinal extent of the one or more first microstructures 100*a*, 100*b*, 100*c* of the one or more tracks 2*a*, 2*b*, 2*c* can follow a contour, in particular the inner contour, preferably the outer contour, of the tracks 2*a*, 2*b*, 2*c*. Further preferably, the alignment of the first microstructures at most points on the one or more tracks, preferably along the entire track in each case, can have the same angle relative to a radius of curvature vector of the one or more tracks. In particular, the alignment and/or longitudinal extent of the one or more first microstructures 100*a*, 100*b*, 100*c* can be aligned predominantly perpendicular, in particular perpendicular, to the radius of curvature vector.

Particularly preferably, the alignment, in particular the preferred direction, of the first microstructures 100*a*, 100*b*, 100*c* at most points, preferably at least at 50% of the points, particularly preferably at 70% of the points, in particular preferably at 85% of the points, ideally for all points on the tracks 2*a*, 2*b* and/or 2*c*, in particular in the case of one or more elliptical and/or circular tracks, can be aligned identically to a perpendicular line on the tracks 2*a*, 2*b*, 2*c*, in particular perpendicular to one or more tangent vectors of the tracks 2*a*, 2*b*, 2*c*.

Preferably, as shown by way of example in FIG. 4, the tracks 2*a*, 2*b* and 2*c* can intersect in an intersection area 11. The intersection area 11 shown in FIG. 4 corresponds geometrically to the surface area in which the curved tracks 2*b* and 2*c* overlie and/or intersect each other, wherein in the embodiment example of FIG. 4 only the first microstructure 100*c* of the track 2*c* and not the first microstructure 100*b* of the track 2*b* is present in the intersection area 11 of the tracks 2*b* and 2*c*.

Figure 5:
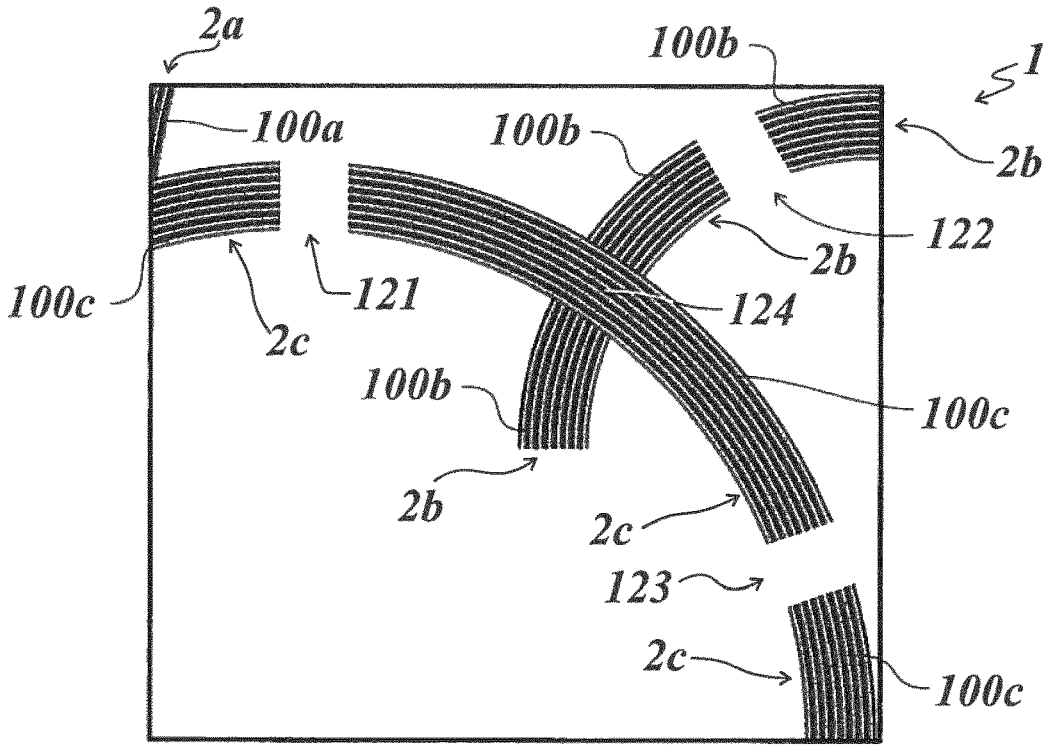

FIG. 5 shows a security element 1 comprising three curved tracks 2*a*, 2*b* and 2*c* with first microstructures 100*a*, 100*b* and 100*c*, wherein the track 2*b* and the track 2*c* in particular intersect in an intersection area 124. Further, the track 2*b* has interruptions 122 and 124. The first microstructure 100*b* is not provided in the interruption 122 and there is an interruption of the microstructure 100*b* in the intersection area 124. Further, the track 2*c* has interruptions 121 and 123, in which the first microstructures 100*c* of the track 2*c* are not provided.

Furthermore, in particular one of the interruptions 121, 122, 123 and 124 can in each case correspond geometrically to the surface area in which the respective tracks 2*a*, 2*b* and/or 2*c* have no first microstructures 100*a*, 100*b* and 100*c*. The interruptions 121, 122, 123 and/or 124 of the respective tracks 2*a*, 2*b* and 2*c* can be randomly and pseudo-randomly distributed. Preferably, the interruptions 121 to 124 can be randomly and/or pseudo-randomly distributed parallel and/or perpendicular to a corresponding tangent vector.

The embodiment example shown in FIG. 5 has a number of interruptions 121, 122, 123, which are arranged outside the intersection area 124 of the track 2*b* and the track 2*c*.

Particularly preferably, the interruptions 121, 122 and/or 123 arranged outside the intersection areas 124 in each case make up between 0.1% and 30%, preferably between 1% and 10% of the surface area and/or of the length of the tracks 2*a*, 2*b* and/or 2*c*. In addition to the optical effect of the microstructures, such interruptions produce a scattering effect, which as a whole leads to a more achromatic impression.

Figure 6:
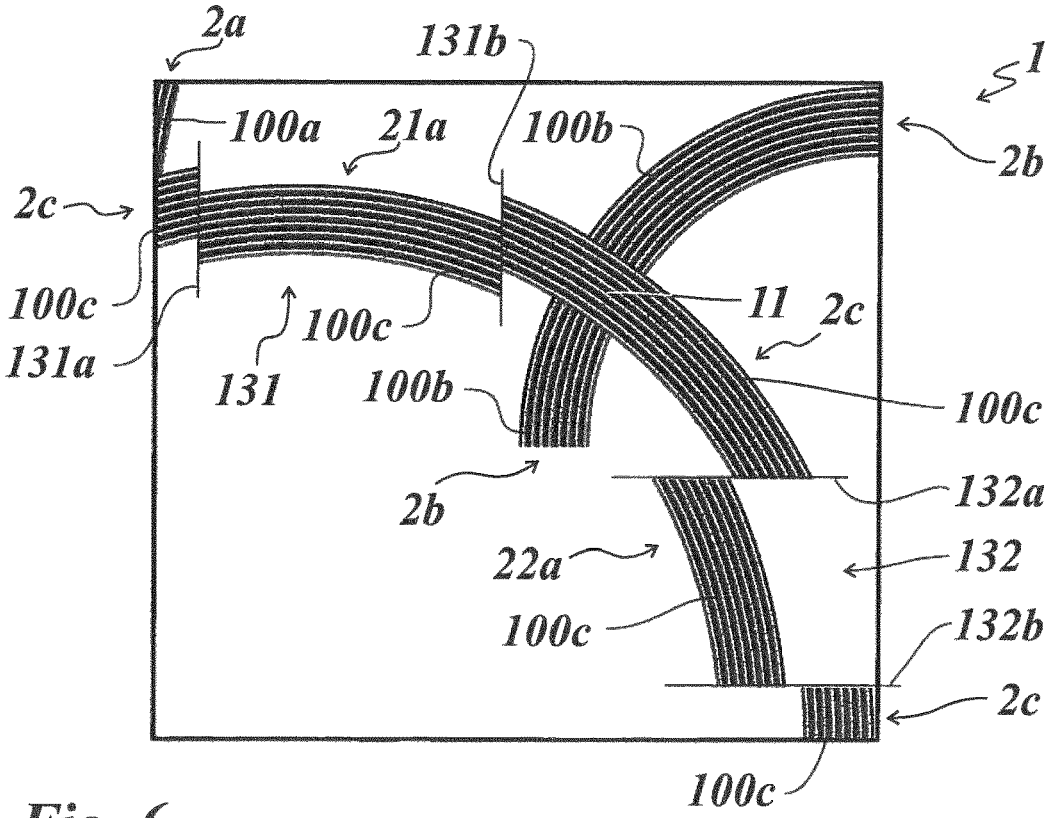

FIG. 6 shows an embodiment example of the security element 1 which has three curved tracks 2*a*, 2*b* and 2*c* with first microstructures 100*a*, 100*b* and 100*c*, wherein the track 2*c* has two offsets 131, 132. The offset 131 runs parallel to the cut edges 131*a*, 131*b*, and the partial area 21*a* of the track is shifted downwards by the length of the offset 131 with respect to the observation direction of FIG. 6. Further, the offset 132 runs parallel to the cut edges 132*a*, 132*b*, and the partial area 22*a* of the track is shifted to the left by the length of the offset 132 with respect to the observation direction of FIG. 6. The shift directions of the offsets 131, 132 are in particular arranged perpendicular to each other.

The surface area of a partial area 21*a*, 22*a* shifted by the offsets 131, 132 is dependent on the width and/or the progression of the width over the progression of the partial areas 21*a* or 22*a* and/or the arc length of the partial areas 21*a* or 22*a*. The partial areas 21*a* or 22*a* here have the width and/or the progression of the width of the original, uncut track 2*c*, from which the partial areas 21*a* or 22*a* were taken or from which the partial areas 21*a* or 22*a* were shifted.

The offsets 131, 132 of the tracks 2*a*, 2*b*, 2*c* and/or of the first microstructures 100*a*, 100*b*, 100*c* can be randomly and/or pseudo-distributed, in particular arranged, and/or randomly and/or pseudo-randomly distributed and/or arranged parallel and/or perpendicular to a corresponding tangent vector.

Further preferably, one or more offsets 131, 132 can make up less than one or more widths of the tracks 2*a*, 2*b* and 2*c* and/or of the first microstructures 100*a*, 100*b* and 100*c*. Preferably, the offsets are shifted between 1 μm and 100 μm, in particular between 3 μm and 50 μm. Similarly to the interruptions from FIG. 5, the offsets also produce an additional scattering effect, which as a whole leads to a more achromatic impression of the security element.

Figure 7:
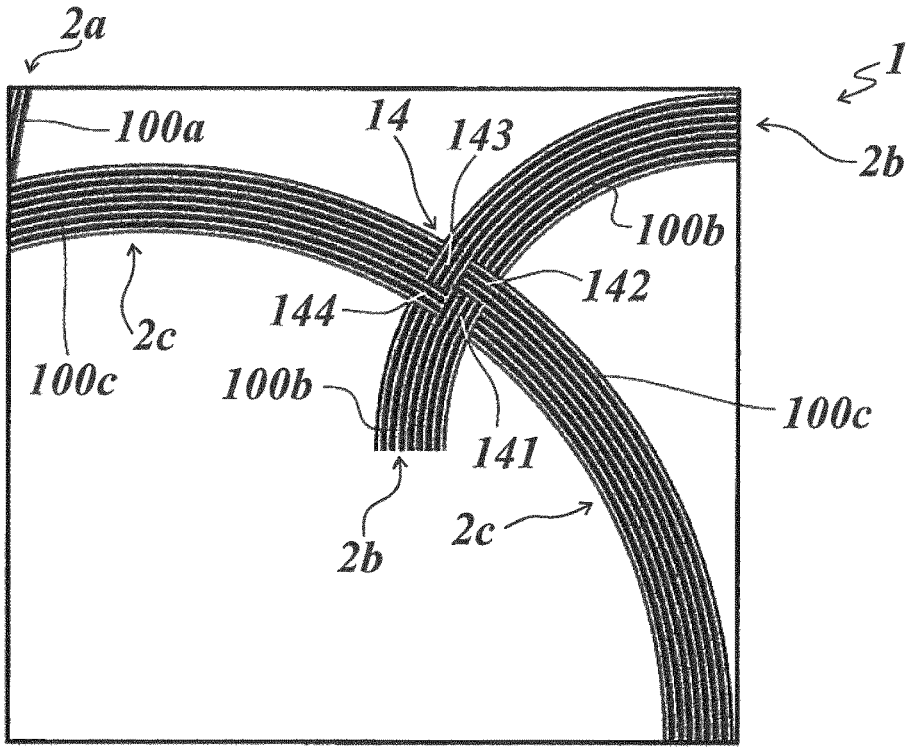

FIG. 7 shows a security element 1 comprising three curved tracks 2*a*, 2*b*, 2*c* with first microstructures 100*a*, 100*b*, 100*c*, wherein the tracks 2*b*, 2*c* have a mosaic surface 14. The mosaic surface 14 is divided into a plurality of partial mosaic surfaces 141, 142, 143, 144, which contain first microstructures 100*b*, 100*c* of the tracks 2*b*, 2*c*, wherein the first microstructure of at least one partial mosaic surface differs from the remaining first microstructures in the partial mosaic surfaces.

In particular, there is a mosaic-type arrangement, in particular a gridding, of the first microstructures 100*b*, 100*c* in the mosaic surface 14 of the tracks 2*b*, 2*c* and/or of the first microstructures 100*b*, 100*c* of the tracks 2*b*, 2*c*. This has the effect that the interruption of the two tracks has a more inconspicuous action for the observer.

Figure 8:
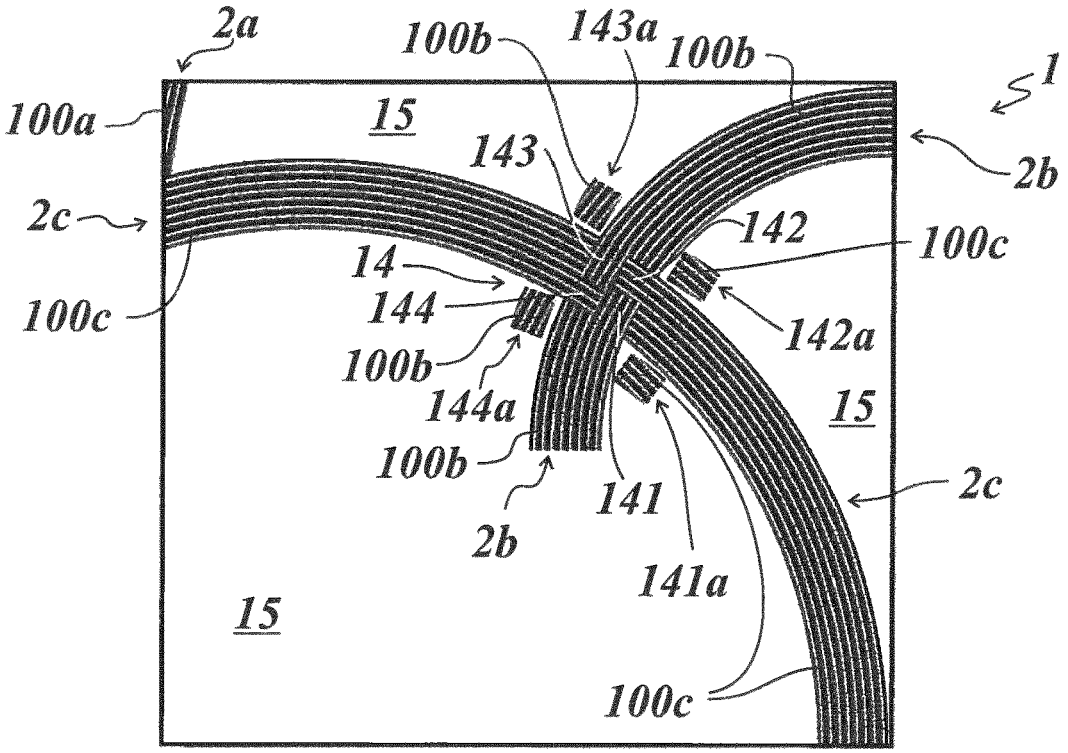

FIG. 8 shows a security element 1 comprising three curved tracks 2*a*, 2*b*, 2*c* with first microstructures 100*a*, 100*b*, 100*c*, wherein the tracks 2*b*, 2*c* in an intersection area 11 have a mosaic surface 14, which is divided into a plurality of partial mosaic surfaces 141, 142, 143, 144 containing first microstructures 100*b*, 100*c*. Further, FIG. 8 shows, in the areas of surface 15, in particular in the proximity of the mosaic surface 14, an arrangement of partial mosaic surfaces 141*a*, 142*a*, 143*a*, 144*a*, wherein these partial mosaic surfaces 141*a*, 142*a*, 143*a*, 144*a* have first microstructures 100*b*, 100*c*.

Preferably, at least one first microstructure 100*b* or 100*c* of a partial mosaic surface 141, 142, 143, 144, 141*a*, 142*a*, 143*a*, 144*a* can differ from the first microstructures of the remaining partial mosaic surfaces.

In particular, the areas of surface 15 and thus further also preferably the partial mosaic surfaces 141*a*, 142*a*, 143*a*, 144*a* are arranged less than 150 μm, preferably less than 50 μm, away from the mosaic surface 14. These partial mosaic surfaces have the effect that the continuous movement effects of the tracks 2*b* and 2*c* appear as uninterrupted for the naked human eye.

FIG. 9*a* shows a security element 1 comprising an image element 3, wherein the image element 3 is composed of the numbers "4" and "2", and the number "4" is arranged above the number "2" from the observation direction of FIG. 9*a*.

FIG. 9*b* shows a security element 1 comprising an image element 3', wherein the image element 3' is composed of a number 4 rotated by 180 degrees and a number 2 rotated by 180 degrees, and the number "2" rotated by 180 degrees is arranged above the number "4" rotated by 180 degrees from the observation direction of FIG. 9*b*.

The tracks and/or the first microstructures and/or the transitions of the tracks in the embodiment example of FIGS. 9*a* and 9*b*, along which the image element 3 transforms into the image element 3' through a movement effect, are arranged in such a way that the tracks and/or first microstructures enables a transformation, in particular a morphing, preferably a flip, from the image element 3 to the image element 3'. The changeover detectable by an observer or the transformation of the image element 3 shown in FIG. 9*a* to the image element 3' shown in FIG. 9*b* is provided by a tilting and/or bending and/or rotation of the security element 1 relative to a light source and/or an observer.

Figure 10A:
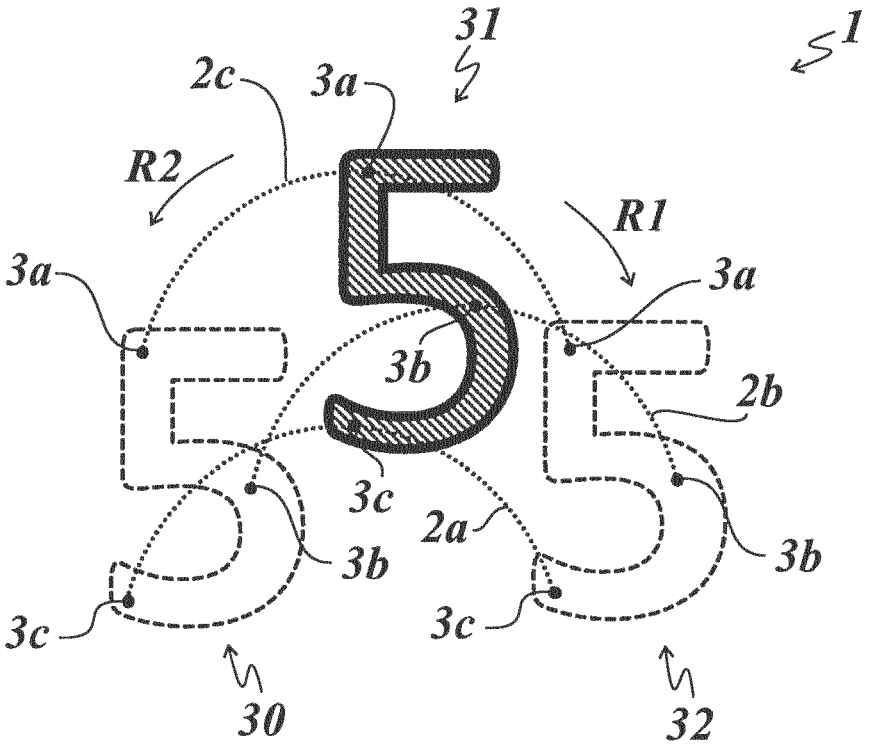

FIG. 10*a* schematically shows a security element 1 comprising an image element 3, wherein the image element 3 is designed as the number "5". Three exemplary image points 3*a*, 3*b*, 3*c* of the image element 3 can move on the curved tracks 2*a*, 2*b*, 2*c* or track sections in both directions of the tracks 2*a*, 2*b*, 2*c* to the positions 30, 31, 32 when the security element 1 is tilted and/or bent and/or rotated. Preferably, an observer detects a continuous movement effect when the security element 1 is tilted and/or bent and/or rotated, wherein the image element 3 can move in particular continuously between the positions 30, 31, 32 in a particular direction R1 along the tracks 2*a*, 2*b*, 2*c* and can provide a movement contrary to the particular direction R1, thus in the direction R2, when the tilting direction and/or bending direction and/or the rotation direction is changed, and vice versa.

Figure 10B:
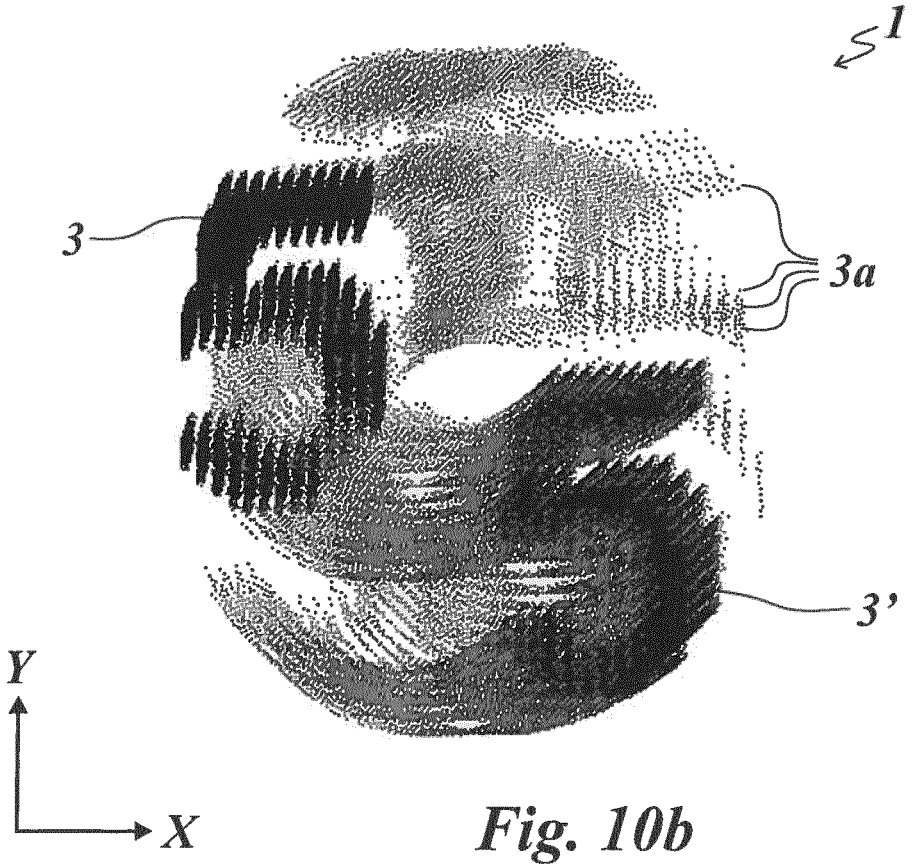

FIG. 10*b* shows an inverted picture of the optical action of a security element 1 under illumination comprising two image elements 3, 3' designed as the number "5", wherein each image element is provided by one light source in each case. Along the circle tracks or circular tracks, shown by sequences of individual image points, which connect the image elements 3, 3', preferably blazed structures, in particular linear blazed gratings, are arranged, wherein in this example the grating period of the blazed gratings is 6 μm and the grating depth of the blazed gratings is 2 μm. In this embodiment example the longitudinal extent of the linear blazed gratings at every location on the tracks is arranged perpendicular to the radius vectors at the corresponding locations on the tracks.

The optical action when the security element shown in FIG. 10*b* is tilted and/or bent and/or rotated consists of the movement of the image elements 3 and 3' formed as the number "5", wherein an observer can obtain a three-dimensional impression through the virtual movement of the image elements underneath or above the security element.

Figure 11A:
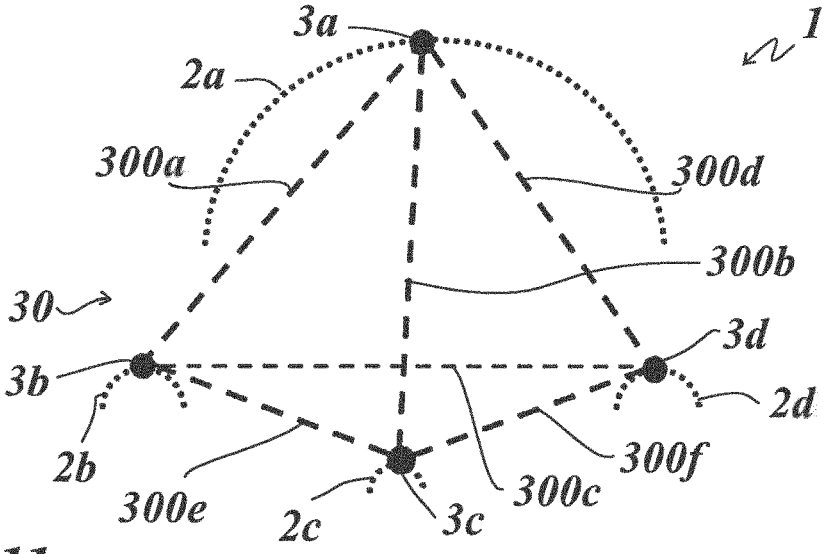
Figure 11B:
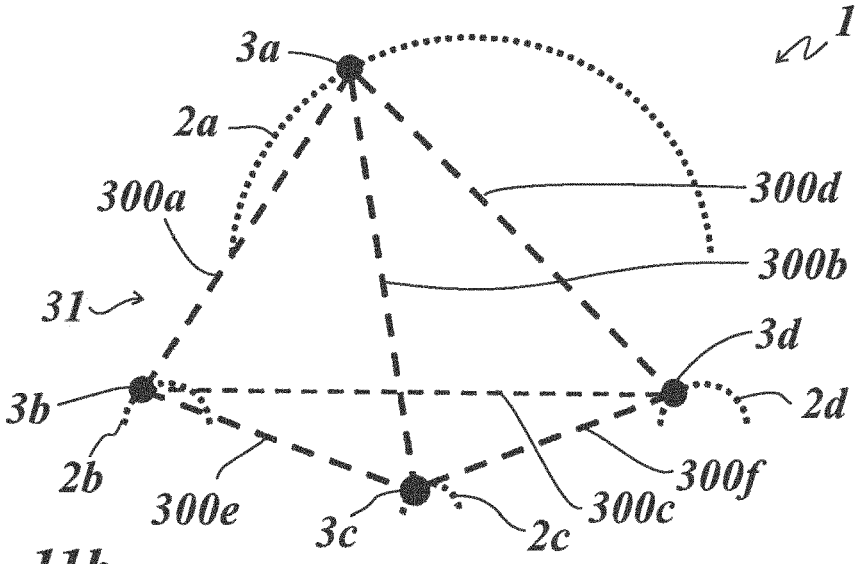
Figure 11C:
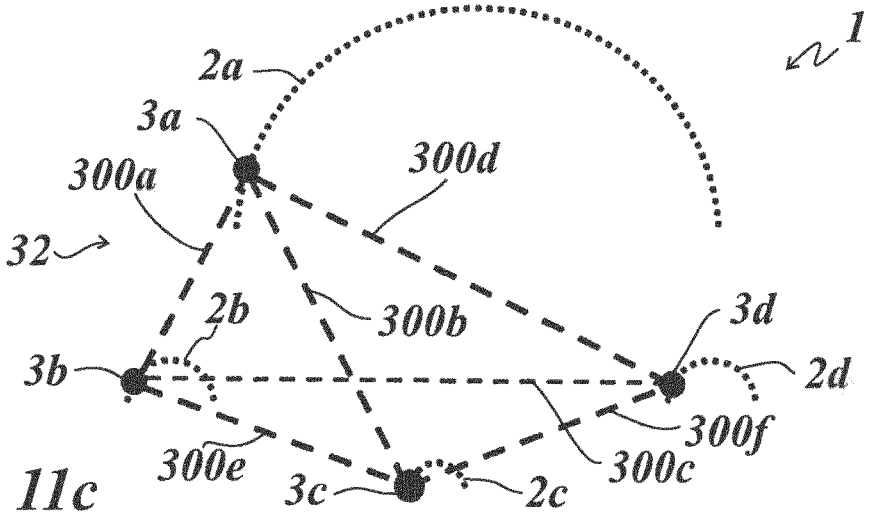

FIGS. 11*a*, 11 *b* and 11*c* schematically show a security element 1 comprising four image points 3*a*, 3*b*, 3*c*, 3*d*, which together form a pyramidal image element 3. The four punctiform elements 3*a*, 3*b*, 3*c*, 3*d* are in each case located on one of the curved tracks 2*a*, 2*b*, 2*c*, 2*d* and form the four corner points of a pyramid made up of four triangular faces, wherein the image points provide a movement effect when the security element 1 is tilted and/or bent and/or rotated, with the result that the image points 3*a*, 3*b*, 3*c*, 3*d* can move forwards and/or backwards on their corresponding tracks 2*a*, 2*b*, 2*c*, 2*d* depending on the tilting direction and/or bending direction and/or rotation direction.

The curved tracks 2*a*, 2*b*, 2*c*, 2*d* shown in FIGS. 11*a*, 11 *b* and 11*c* have different radii of curvature from each other, wherein the track 2*a* has a smaller curvature than the tracks 2*b*, 2*c*, 2*d*.

Further, FIGS. 11*a*, 11 *b* and 11*c* show the four image points 3*a*, 3*b*, 3*c*, 3*d* in each case in different positions 30, 31, 32 in the course of a movement on the corresponding tracks 2*a*, 2*b*, 2*c*, 2*d*, wherein the image point 3*a*, due to the smaller curvature of the track 2*a* compared with the curvatures of the tracks 2*b*, 2*c*, 2*d* between FIGS. 11*a*, 11 *b* and 11*c*, covers a longer stretch of the track 2*a* than the image points 3*b*, 3*c*, 3*d*, with the result that a three-dimensional movement effect of the pyramid detectable for an observer is provided.

Such a three-dimensional effect or 3D effect, represented in FIGS. 11*a*, 11 *b* and 11*c*, is produced by the formation of the image element 3 as a two-dimensional projection of a three-dimensional pyramid, wherein the positions of the three image points 3*b*, 3*c*, 3*d* of the pyramid change only slightly during a movement because of the corresponding strong curvatures of the tracks 2*b*, 2*c*, 2*d*, while the image point 3*a* at the tip of the pyramid covers a long stretch over the slightly curved track 2*a*. The pyramid is thus deformed in the course of a movement effect from the point of view of an observer in such a way that the observer's brain interprets this deformation of the pyramid as the deformation of a three-dimensional object in three-dimensional space.

The movement effect of the image points 3*a*, 3*b*, 3*c*, 3*d* can be provided by a tilting and/or bending and/or a rotation of the security element 1 relative to at least one light source and/or relative to the observer.

Figure 12A:
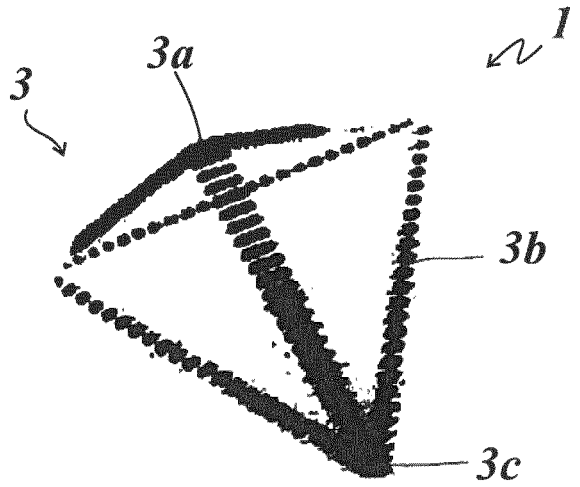
Figure 12B:
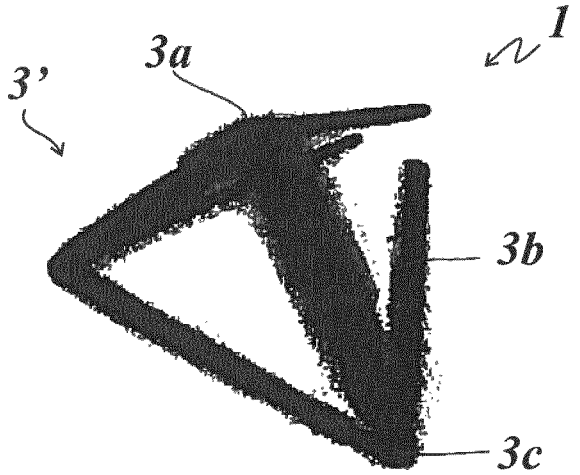

FIGS. 12*a* and 12*b* show the inverted optical action of a security element 1 shown in FIG. 11*a* comprising two image elements 3, 3' composed of a plurality of image points 3*a*, 3*b* arranged on tracks, wherein the image elements have the same pyramidal shape as each other. The image points 3*a* of the image elements 3 are spaced apart from each other in such a way that their distances from each other can be resolved by a human eye, with the result that the individual image points of the pyramidal image element 3 in FIG. 12*a* can be perceived. The image points 3*b* of the image element 3' on the other hand have such a high density that the distances of the individual points from each other can no longer be resolved with a human eye, with the result that the pyramidal image element 3' can be perceived as a slightly blurred or continuous pyramidal arrangement.

The radii of the circle tracks or circular tracks of the tracks shown in FIGS. 11*a*, 11 *b*, 11*c*, 12*a*, 12*b* lie between 10 mm for the image point 3*a* in the tip of the pyramid and 1 mm for the image point 3*c* in the base of the pyramid.

Figure 13A:
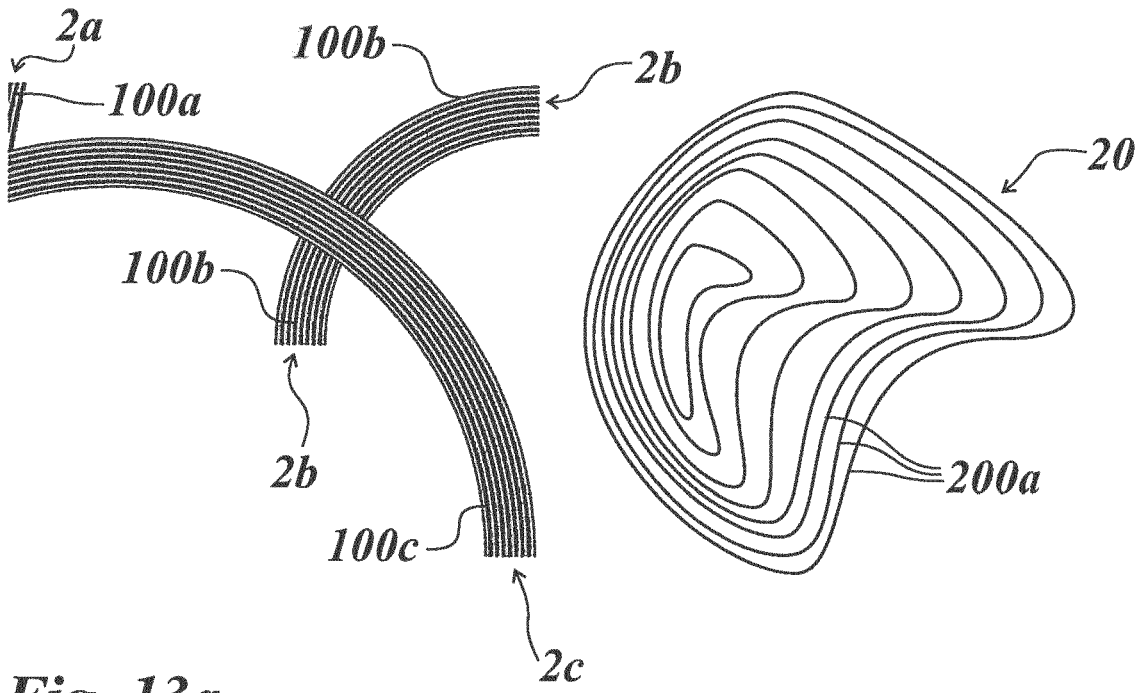
FIGS. 13*a*, 13*b*: schematic representation of a security element with first and second microstructures
Figure 13B:
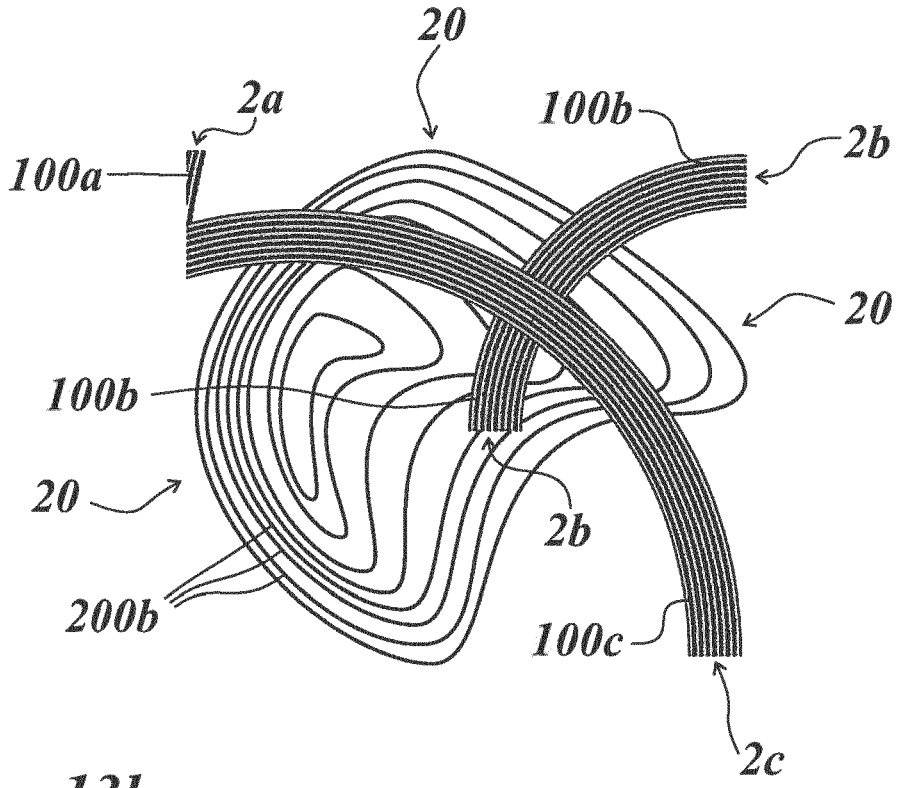

FIG. 13*a* and FIG. 13*b* show by way of example a security element 1, in which a second item of optical information is further generated by one or more second microstructures.

FIG. 13*a* shows a security element 1, in which in particular the arrangement of tracks 2*a*, 2*b* and 2*c* shown in FIG. 4 with the first microstructure elements 100*a*, 100*b* and 100*c* is provided next to an area of surface with a second microstructure 20. The first microstructure elements 100*a*, 100*b* and/or 100*c* here do not overlap with the second microstructure elements 200*a* of the microstructures 20.

FIG. 13*b* shows an arrangement of first and second microstructures, in which one or more of the tracks generating the first optical variable effect, here the tracks 2*a*, 2*b*, intersect the area of surface of the second microstructure 20.

Preferably, in the case according to FIG. 13*b* the area of surface of the second microstructure 20 and of the tracks 2*a*, 2*b* can also be gridded in each other. For this, the microstructure 20 and the tracks 2*a*, 2*b*, 2*c* are broken down in each case into a plurality of strip-shaped partial areas in at least one particular direction. These strip-shaped partial areas are in each case arranged relative to each other in such a way that a strip-shaped partial area comprising the microstructure 20 or a part of the microstructure 20 is adjacent to both intersection sides with in each case a strip-shaped partial area comprising one or more of the tracks 2*a*, 2*b*, 2*c* or parts of the tracks 2*a*, 2*b*, 2*c* and vice versa, with the result that the strip-shaped partial areas comprising the microstructures and the strip-shaped partial areas comprising the tracks alternate with one another spatially in a direction perpendicular to the intersection direction. The strip width here is preferably less than 300 μm.

The second microstructures 20 preferably generate an item of optically variable information.

The second microstructures 20 preferably in each case comprise a plurality of second microstructure elements 200*a*, 200*b*, wherein the second microstructure elements 200*a*, 200*b* are preferably characterized by the parameters spacing of the second microstructure elements, relief depth, relief shape and orientation of the longitudinal direction of the second microstructure elements.

The second microstructure elements 200*a* and/or 200*b* here are preferably formed as linear structure elements in particular with a triangular profile, which are arranged as illustrated in FIG. 13*b* and provide a three-dimensionally appearing relief image, in particular a three-dimensionally achromatically appearing relief image, as second optical effect.

Further, the second microstructures 20 can also have a plurality of second facet faces, which provide a relief image depending on the progression and/or angle of inclination progression of the facet faces when light is reflected and/or diffracted.

The second microstructures can, however, in each case also be formed as a grating, in particular a sinusoidal and/or triangular grating, an anisotropically scattering structure, a matte structure, a blazed grating and/or a surface relief hologram. The first and/or second microstructures can also be combined with a metallic and/or HRI reflective layer and/or a layer bringing about a color shift effect, as already stated above. The first and second microstructures can also be converted into a volume hologram by means of holographic exposure.

Figure 14A:
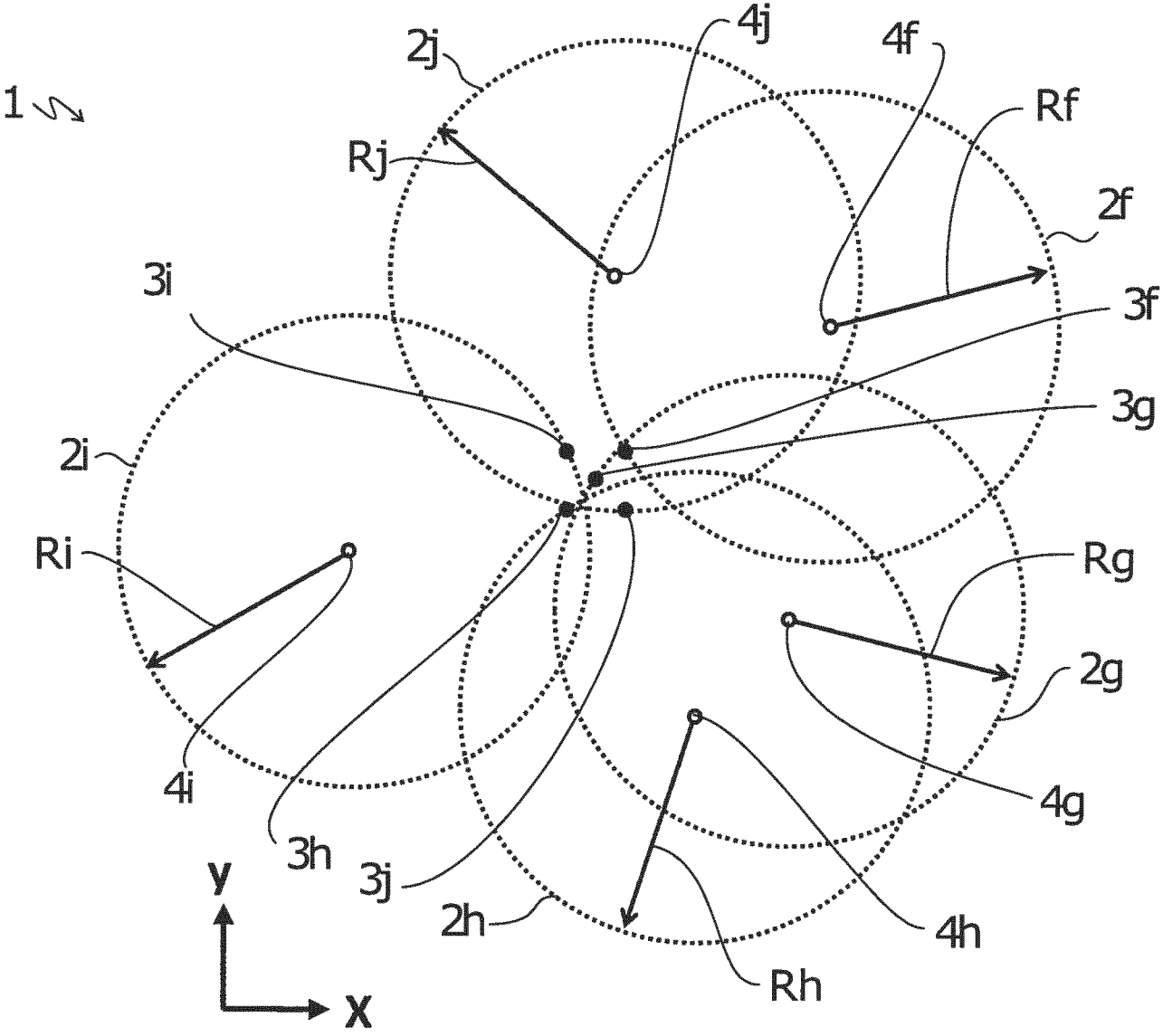
FIG. 14*a*: schematic representation of a security element with several tracks
Figure 14B:
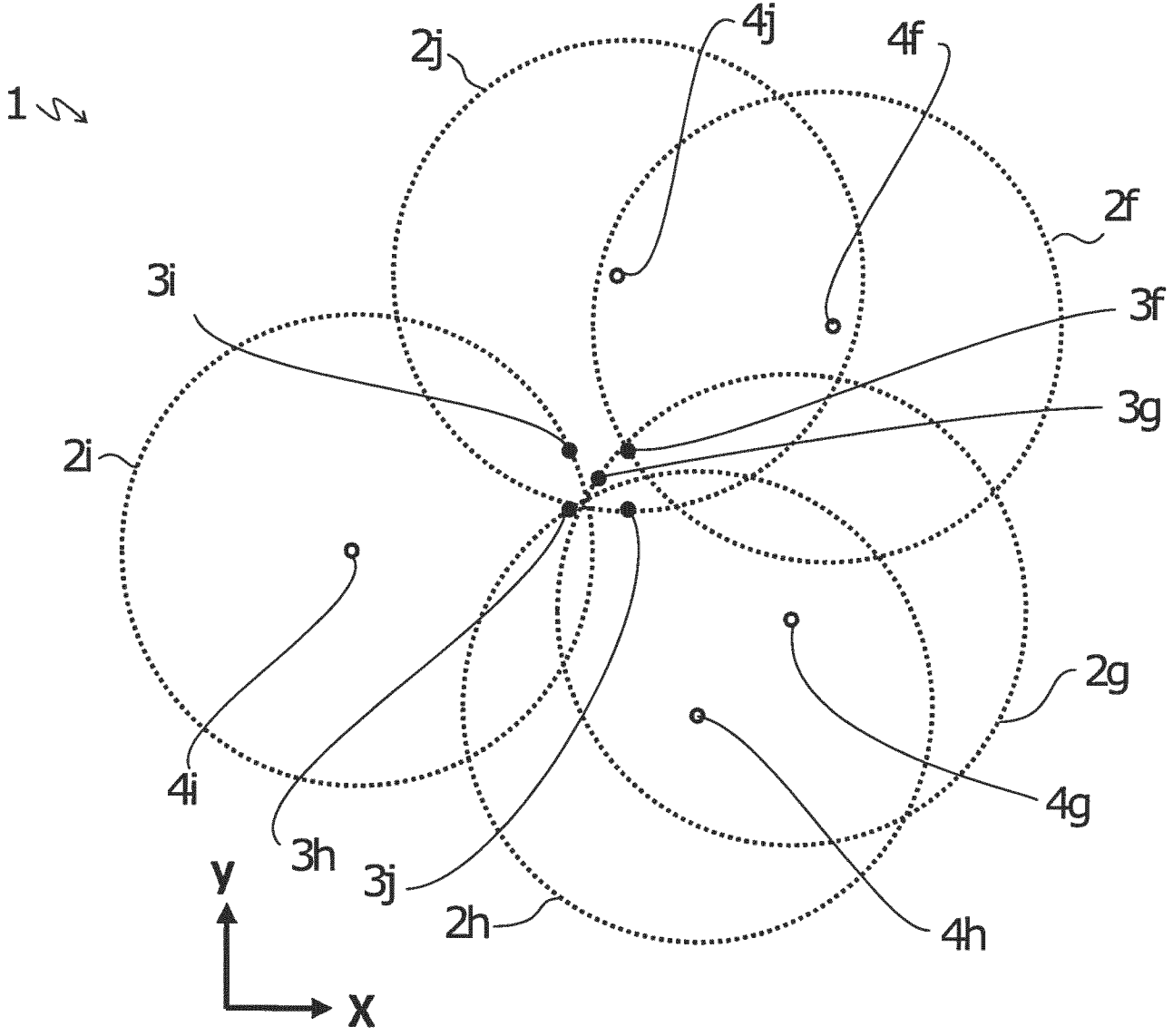
FIG. 14*b*: schematic representation of a security element with several tracks
Figure 14C:
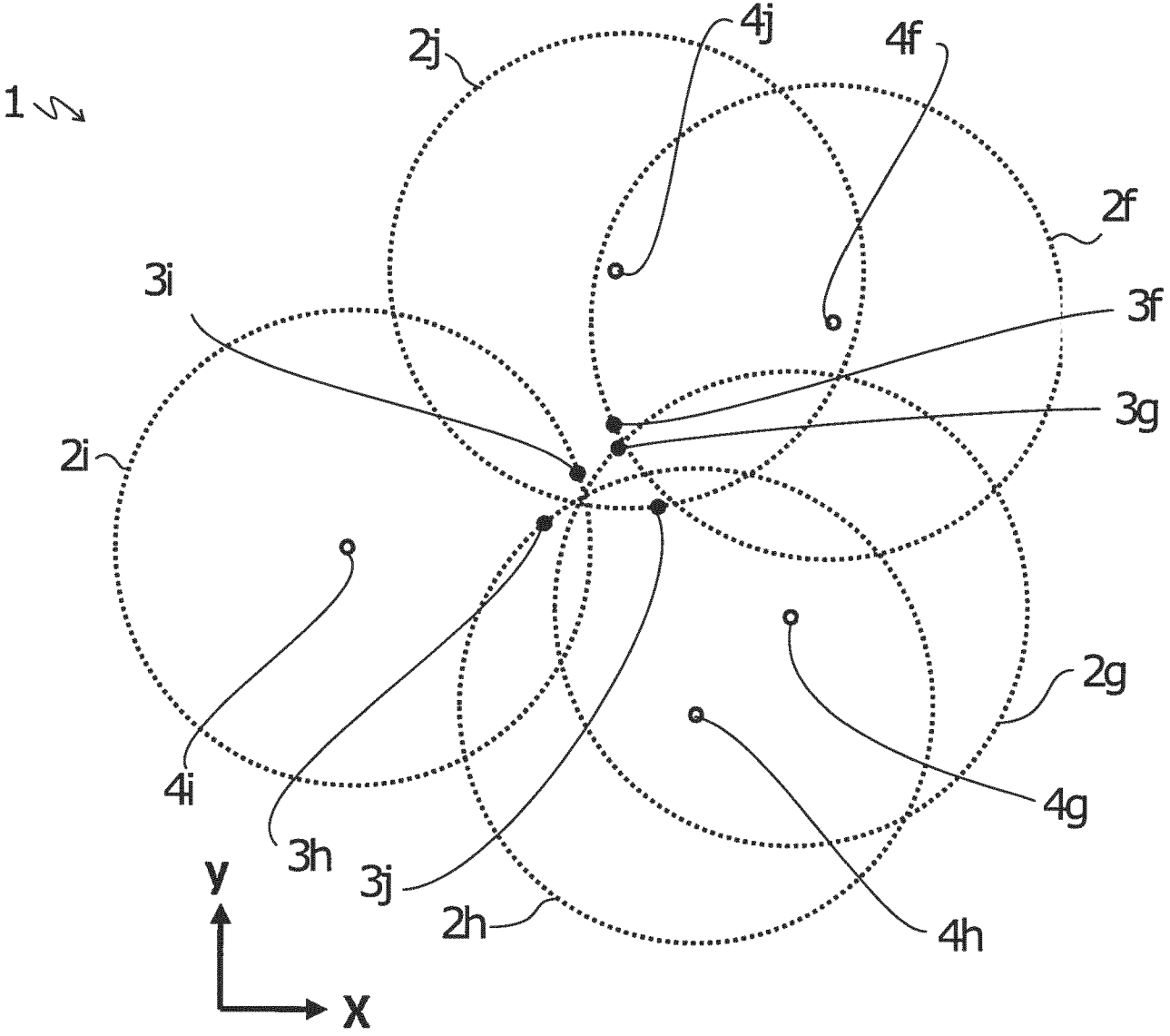
FIG. 14*c*: schematic representation of a security element with several tracks
Figure 14D:
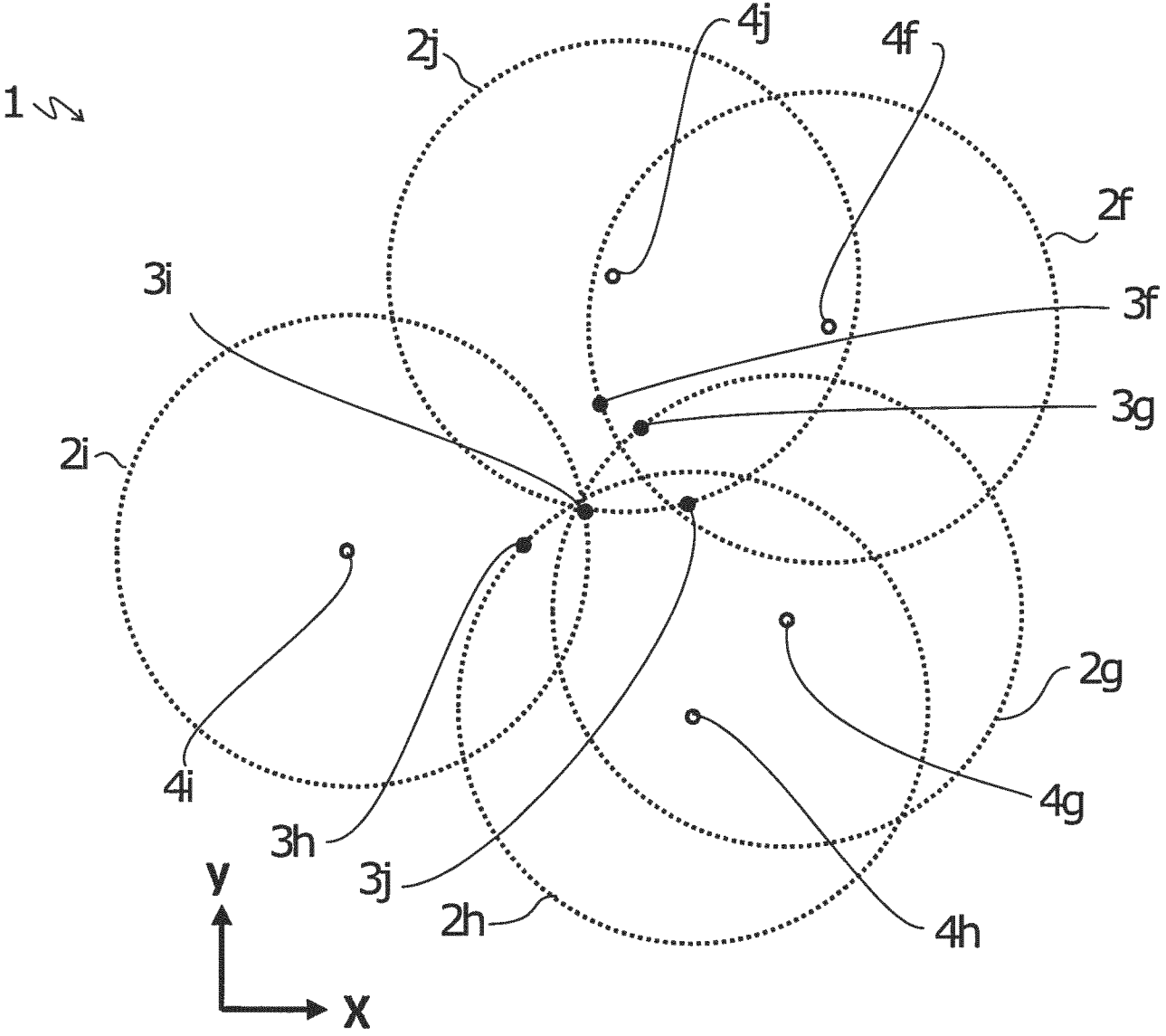
FIG. 14*d*: schematic representation of a security element with several tracks
Figure 14E:
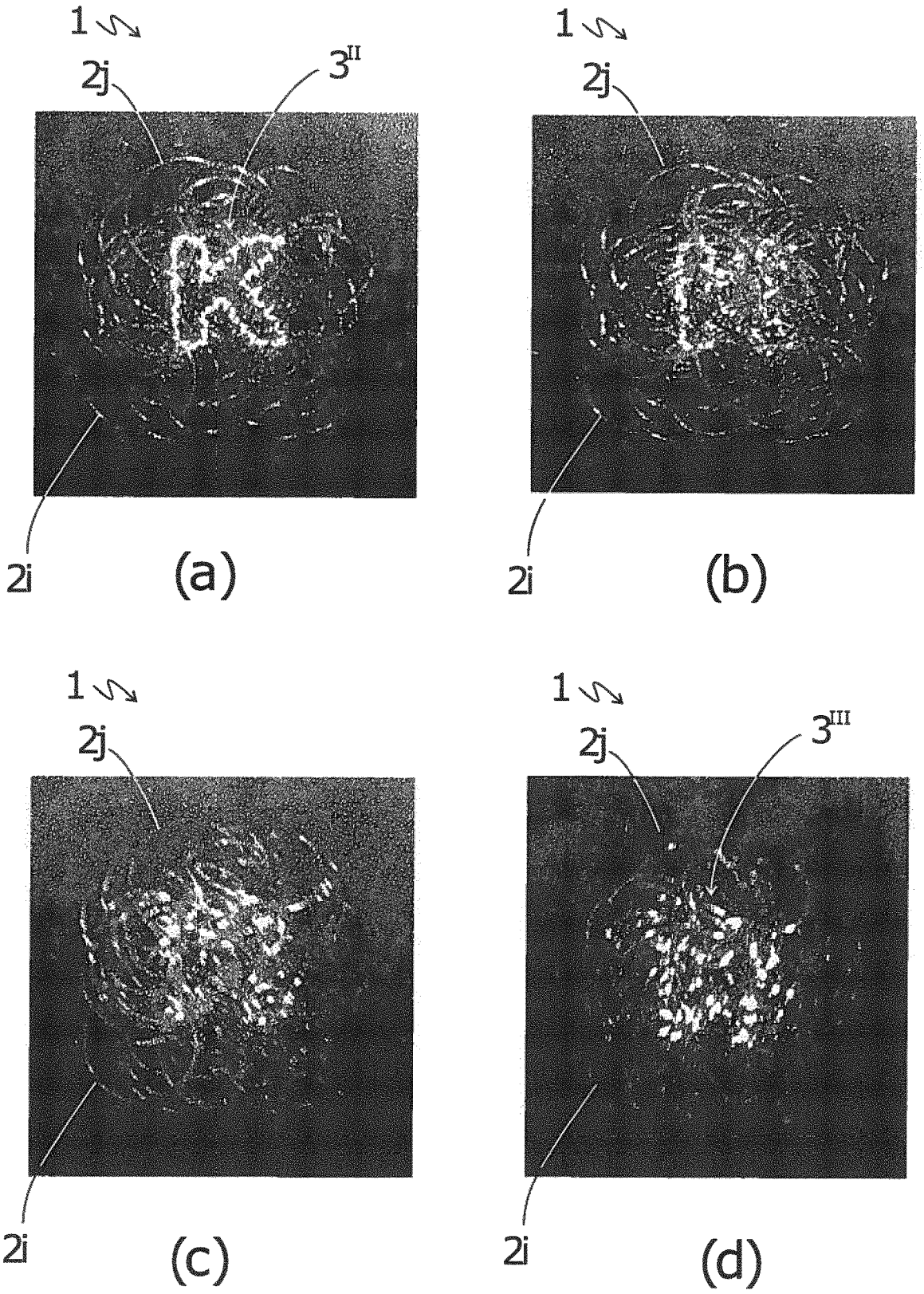
FIG. 14*e*: schematic representation of a security element with several tracks

FIGS. 14*a* to 14*e* show the structure of a security document with a security element 1. FIGS. 14*a* to 14*d* show a security element 1 in a top view and FIG. 14*e* shows photographs of a pattern of a security element 1 at different observation angles.

The same image element consisting of five points or image points 3*f*, 3*g*, 3*h*, 3*i*, 3*j* as the image element in FIG. 1*a* is shown in FIG. 14*a*. Unlike in FIG. 1*a*, however, the centers or center points 4*f*, 4*g*, 4*h*, 4*i*, 4*j* of the circle tracks or circular tracks 2*f*, 2*g*, 2*h*, 2*i*, 2*j* are randomly or pseudo-randomly arranged. The arrangement of the centers or center points 4*f*, 4*g*, 4*h*, 4*i*, 4*j* also does not show the image element consisting of the five points or the five image points 3*f*, 3*g*, 3*h*, 3*i*, 3*j*, in particular arranged according to the positions of the five points or the five image points 3*f*, 3*g*, 3*h*, 3*i*, 3*j*. The microstructures in the tracks 2*f*, 2*g*, 2*h*, 2*i*, 2*j* are preferably chosen and arranged in such a way that at a predetermined illumination and/or observation angle the desired image element, in particular comprising the image points 3*f*, 3*g*, 3*h*, 3*i*, 3*j*, appears to an observer. At all other illumination and/or observation angles the image points 3*f*, 3*g*, 3*h*, 3*i*, 3*j* on the tracks 2*f*, 2*g*, 2*h*, 2*i*, 2*j* diverge and the image element, in particular comprising the image points 3*f*, 3*g*, 3*h*, 3*i*, 3*j*, is no longer detectable. FIGS. 14*b* to 14*d* schematically show the divergence of the five image points in this example 3*f*, 3*g*, 3*h*, 3*i*, 3*j*.

Optionally, only sections of tracks are present, wherein these sections preferably end where the image element is to be seen or is detectable at the predetermined illumination and/or observation angle. This makes it easier in particular to find the correct or appropriate angle configuration. Likewise, there is optionally the possibility of allocating randomly or pseudo-randomly different radii to the circle tracks or circular tracks.

FIG. 14*e* (*a*) to (*d*) shows photographs of an exemplary design of a security element 1 which is constructed of circle tracks or circular tracks with pseudo-randomly arranged centers or center points of the circle tracks or circular tracks, wherein two circle tracks or circular tracks of the circle tracks or circular tracks are respectively provided with the reference numbers 2*i* and 2*j*. In the central observation position, in particular shown in FIG. 14*e* (*a*), the image element $\mathbf{3}^{II}$ constructed of image points is to be seen in the form of the letter "K". When the security element 1 is tilted to the right the image points diverge, the defined allocation is lost and the image element $\mathbf{3}^{II}$ is no longer detectable, as shown in FIGS. 14*e* (*b*) to 14*e* (*d*). In particular, the image element $\mathbf{3}^{II}$ detectable as the letter "K" turns into a diffuse image element $\mathbf{3}^{III}$ in the case of tilting to the right.

Figure 15:
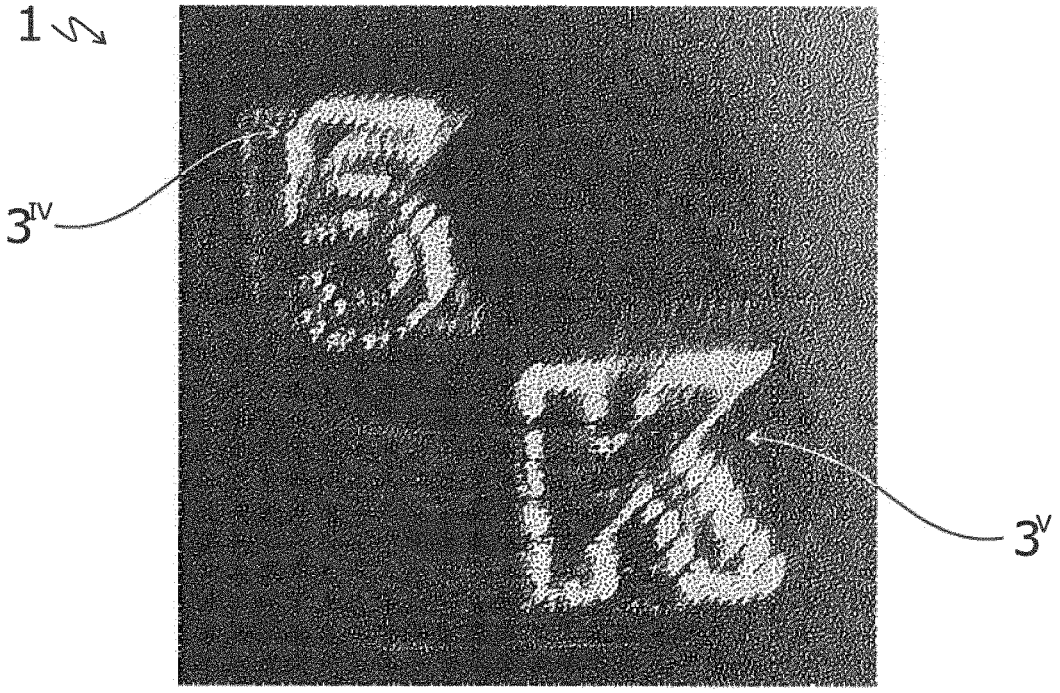
FIG. 15: schematic representation of the optical action of a security element
Figure 15:
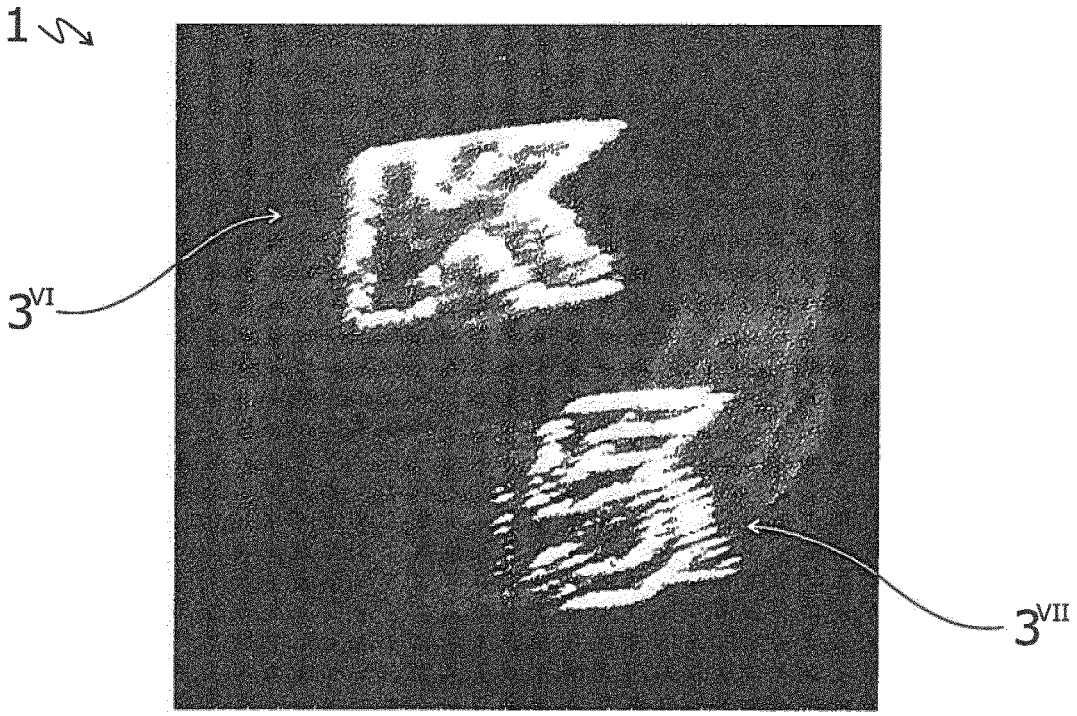
Figure 16A:
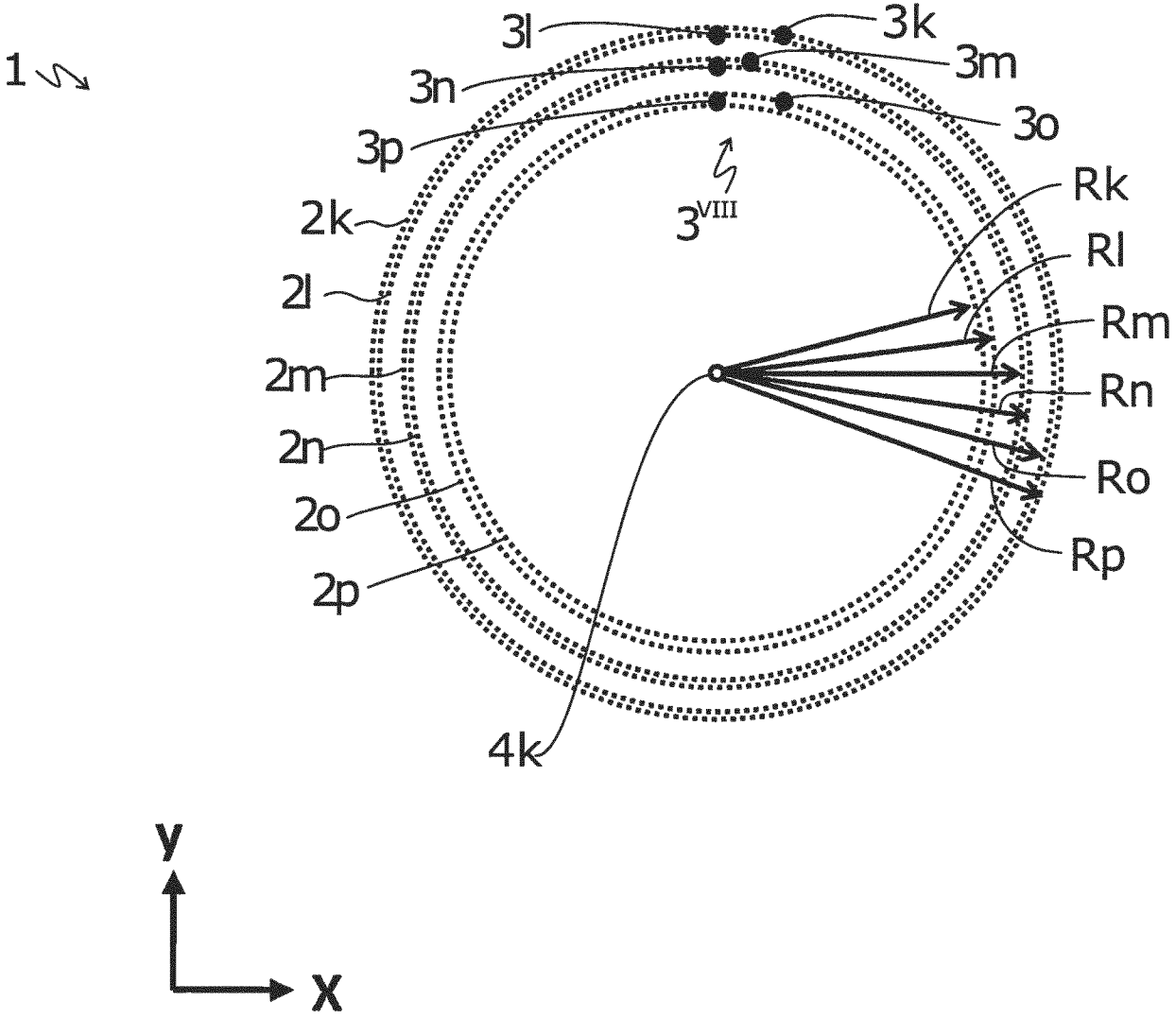
FIG. 16*a*: schematic representation of a security element with several tracks
Figure 16B:
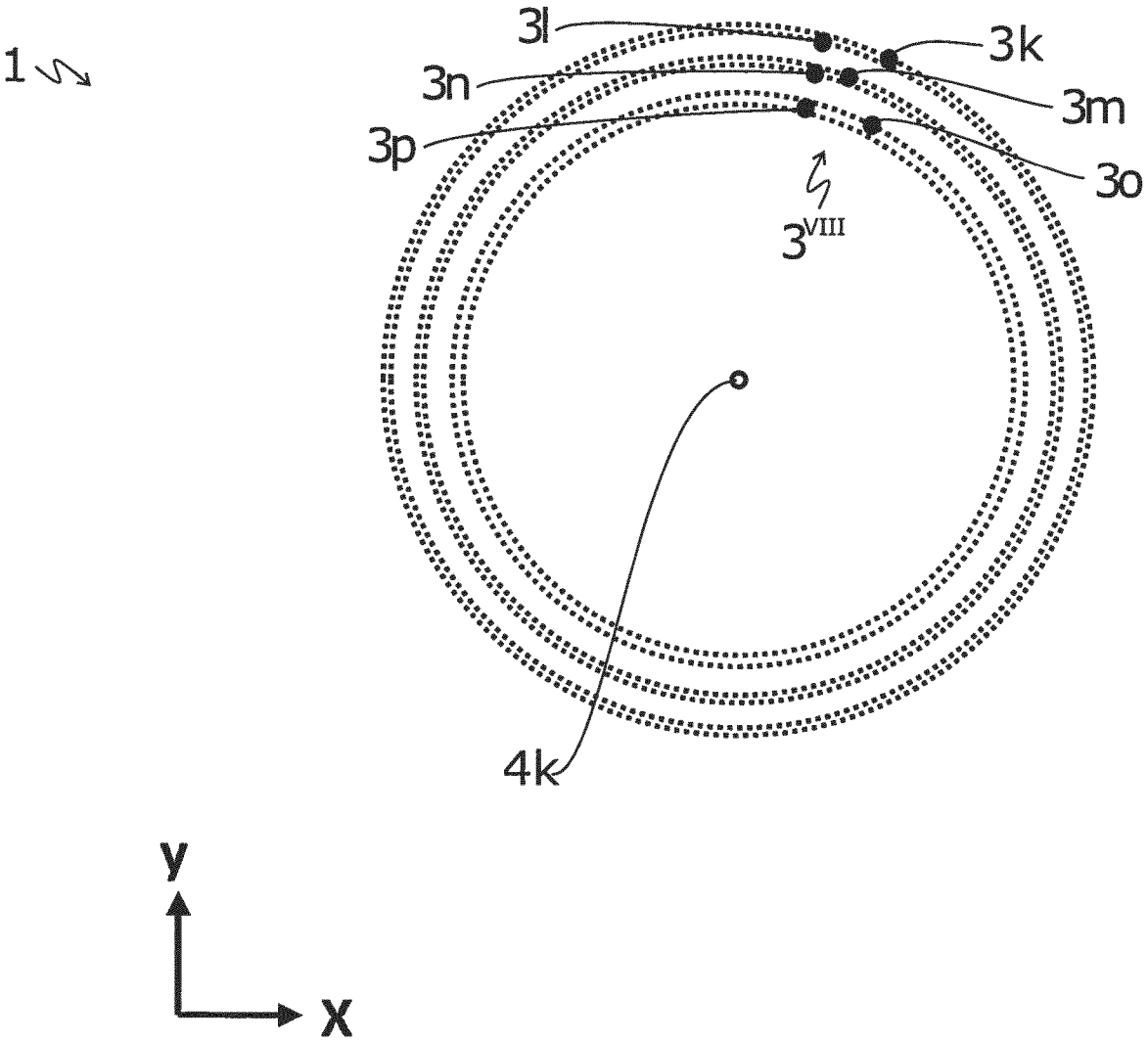
FIG. 16*b*: schematic representation of a security element with several tracks
Figure 16C:
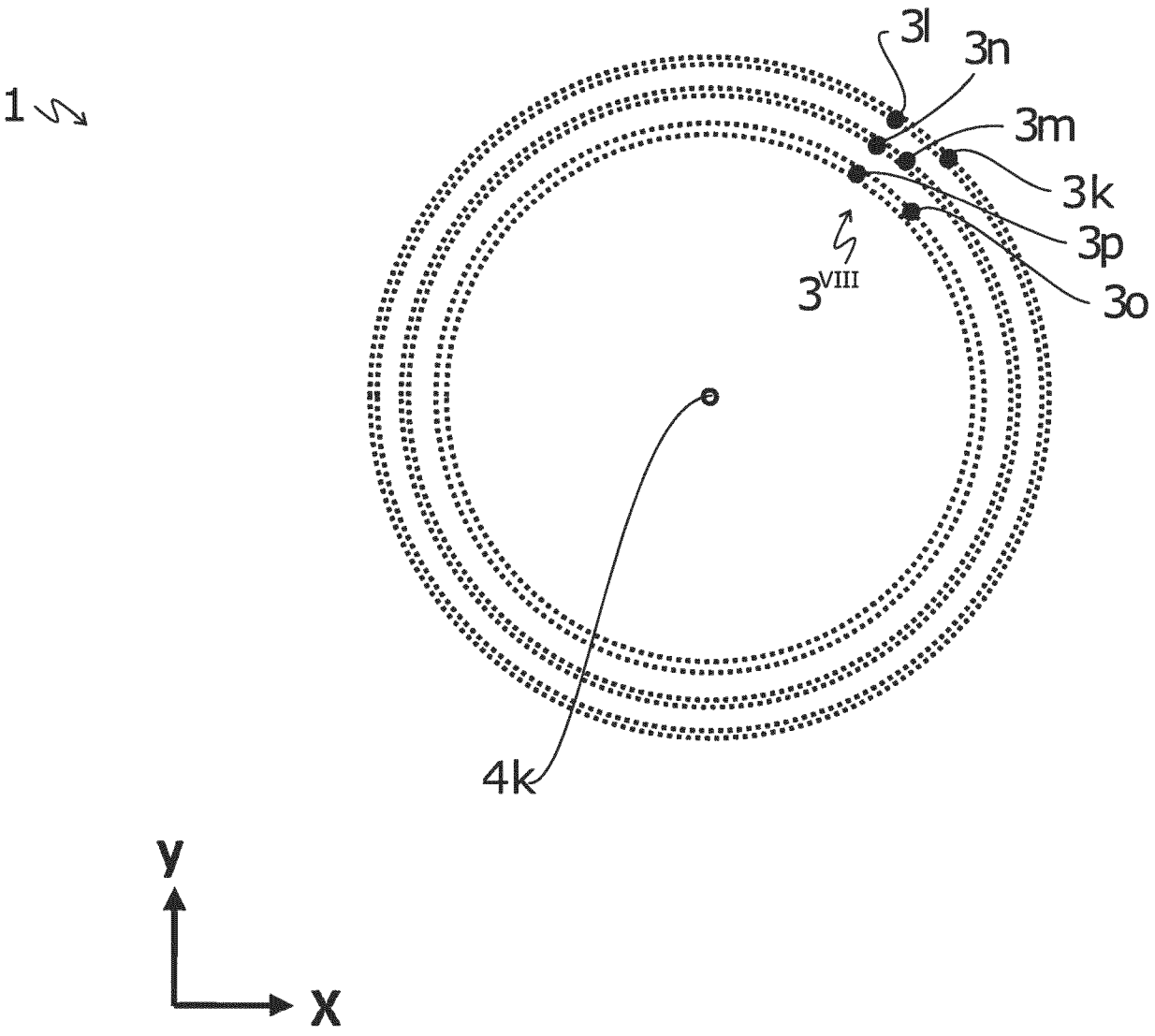
FIG. 16*c*: schematic representation of a security element with several tracks
Figure 16D:
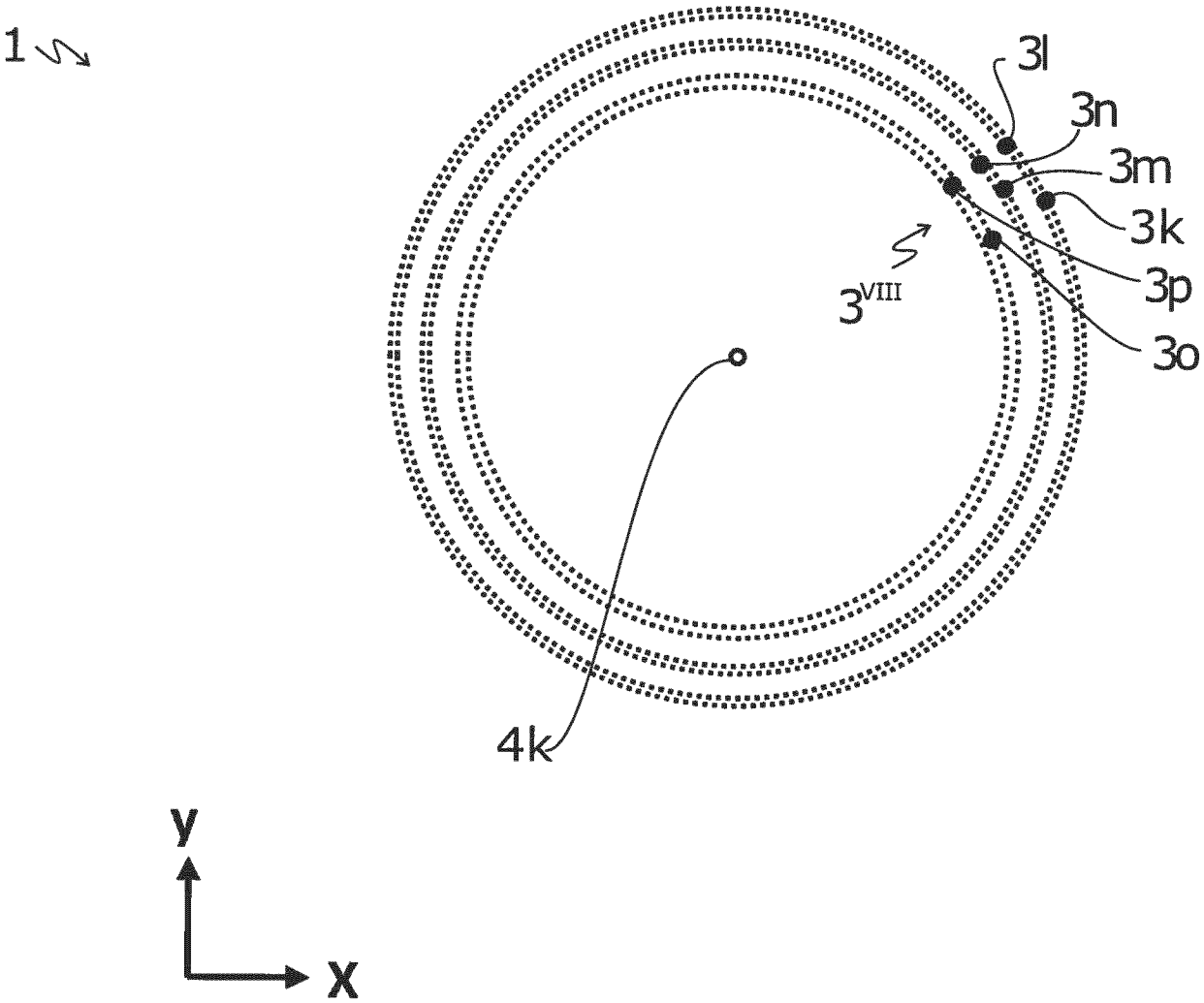
FIG. 16*d*: schematic representation of a security element with several tracks
Figure 17A:
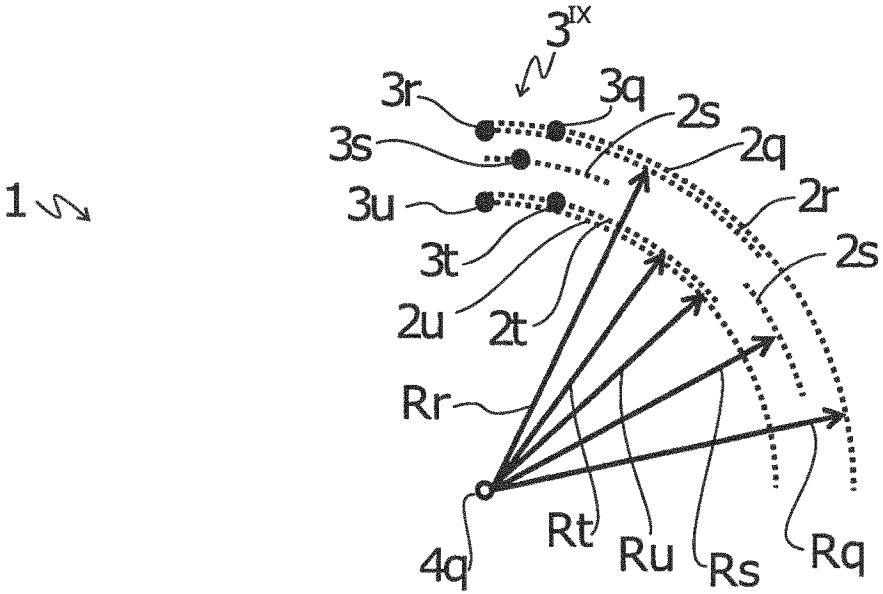
FIG. 17*a*: schematic representation of a security element with several tracks
Figure 17B:
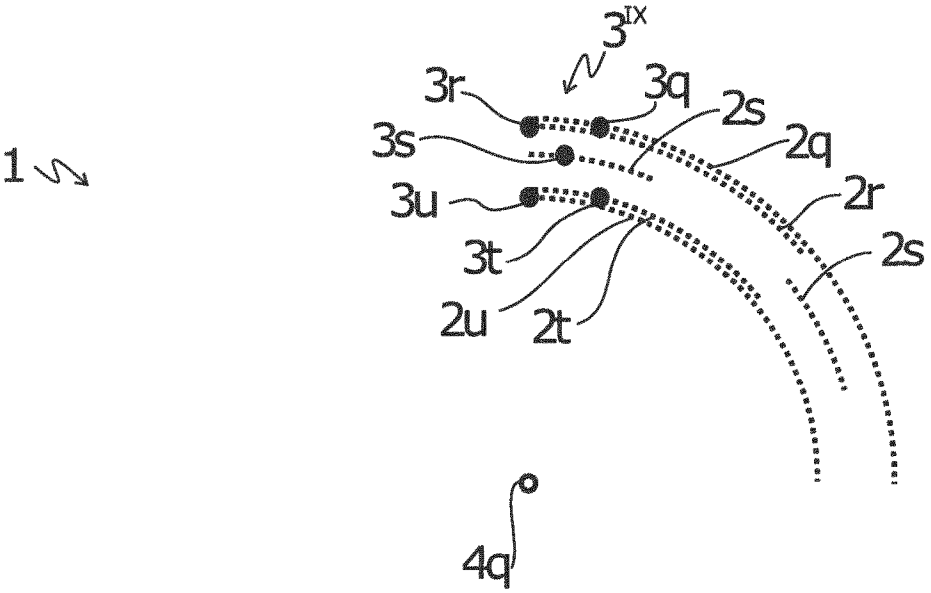
FIG. 17*b*: schematic representation of a security element with several tracks
Figure 17C:
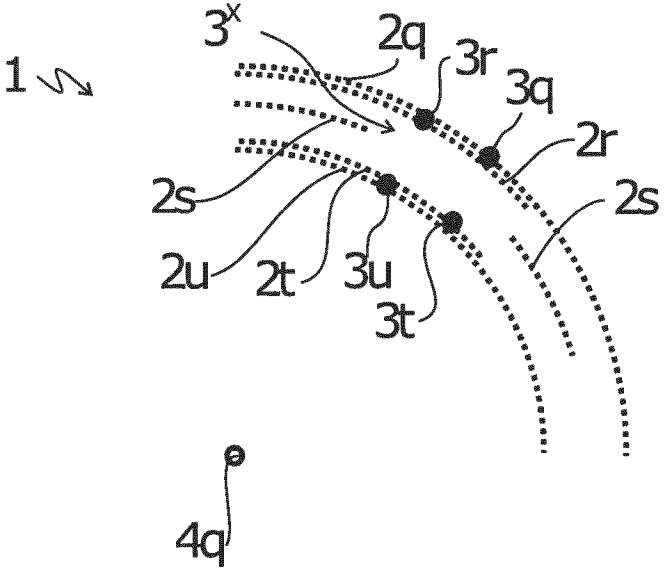
FIG. 17*c*: schematic representation of a security element with several tracks
Figure 17C:
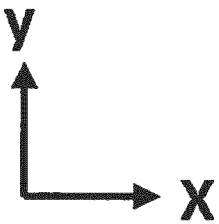
Figure 17D:
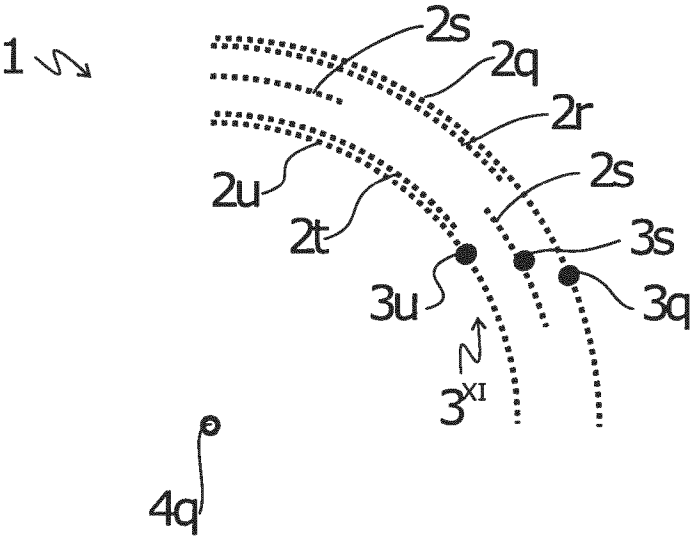
FIG. 17*d*: schematic representation of a security element with several tracks
Figure 17D:
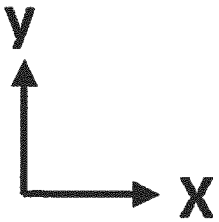
Figure 17E:
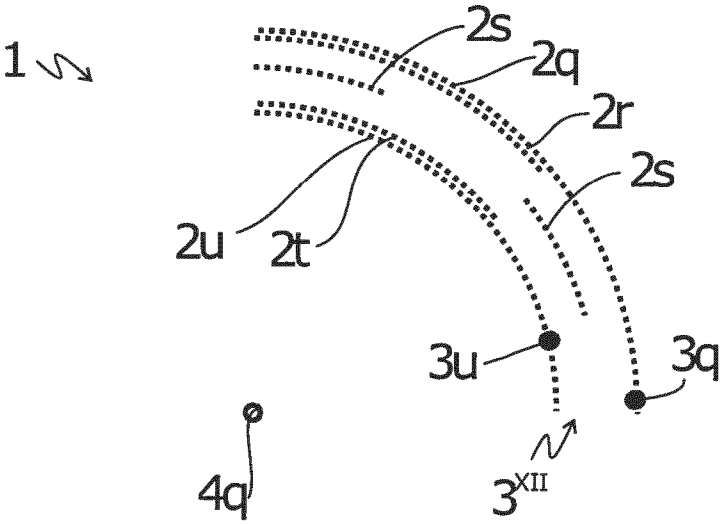
FIG. 17*e*: schematic representation of a security element with several tracks
Figure 17E:
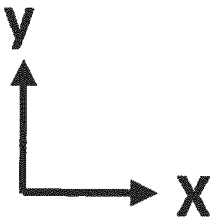

FIG. 15 shows two pictures of the optical action of a security element 1 comprising two image elements $\mathbf{3}^{IV}$ and $\mathbf{3}^{V}$ image elements designed as the number "5" and the letter "K" under an illumination. The two image elements $\mathbf{3}^{IV}$ and $\mathbf{3}^{V}$ are preferably already provided by a single light source. Here, circle tracks or circular tracks are preferably calculated for the two image elements $\mathbf{3}^{IV}$ and $\mathbf{3}^{V}$ and then laid one on top of the other. Preferably, calculation software approximately equally allocates a number of intersection points of the circle tracks or circular tracks to the two image elements $\mathbf{3}^{IV}$ and $\mathbf{3}^{V}$. It is hereby achieved that both image elements $\mathbf{3}^{IV}$ and $\mathbf{3}^{V}$ in particular appear approximately similarly bright. The microstructures are preferably asymmetrical, in particular blaze-type structures, such as e.g. blazed gratings or micromirrors. These microstructures are now arranged and aligned in the circle tracks or circular tracks of the two image elements $\mathbf{3}^{IV}$ and $\mathbf{3}^{V}$ in such a way that the two image elements $\mathbf{3}^{IV}$ and $\mathbf{3}^{V}$ preferably do not light up at the same position of the circle tracks or circular tracks. Preferably, they appear precisely opposite on the circle tracks or circular tracks. The microstructures are for example arranged in such a way that the two image elements $\mathbf{3}^{IV}$ and $\mathbf{3}^{V}$ in particular move in the same direction in the circle. The optical action when the security element shown in FIG. 15 is tilted and/or rotated consists of the positions of the image elements "5" and "K" preferably swapping on the circle track or circular track. In particular also in this example, the grating period of the blazed gratings is 6 μm and the grating depth of the blazed gratings is 2 μm. If, instead of blazed gratings, symmetrical gratings, such as e.g. sinusoidal gratings, were used, then both image elements would appear in particular simultaneously and thus in particular overlaid at the two positions. By checking the exchange of places or position change of the two image elements in the case of tilting and/or rotation, a simple, indirect proof of the presence of blaze-type microstructures is preferably possible.

As described previously, FIG. 15 (*a*) shows the security element 1 comprising the image elements $3^{IV}$ and $3^{V}$, wherein the image element $3^{IV}$ is designed as the number "5" and is detectable as such for an observer, and the image element $3^{V}$ is designed as the letter "K" and is detectable as such for an observer. FIG. 15 (*b*) shows the security element 1 comprising the image elements $3^{VI}$ and $3^{VII}$ after a tilting of the security element 1 shown in FIG. 15 (*a*) to the right, wherein the image element $3^{VI}$ is designed as the number "K" and is detectable as such for an observer, and the image element $3^{VII}$ is designed as the letter "K" and is detectable as such for an observer. Preferably, the image element $3^{IV}$ (number "5") at its position when the security element 1 is tilted to the right is replaced by the image element $3^{VI}$ (letter "K") and the image element $3^{V}$ (letter "K") at its position when the security element 1 is tilted to the right is replaced by the image element $3^{VII}$ (number "5").

FIGS. 16*a* to 16*d* show the structure of a security document comprising a security element 1. Here, the centers or center points 4*k*, in particular of at least 75%, preferably of at least 90%, in particular preferably of all, circle tracks or circular tracks 2*k*, 2*l*, 2*m*, 2*n*, 2*o*, 2*p* are identical, or almost identical. By almost identical is meant in particular that the centers or center points 4*k*, in particular of most, preferably of all, circle tracks or circular tracks 2*k*, 2*l*, 2*m*, 2*n*, 2*o*, 2*p* have a maximum distance from each other, in particular of not more than 10% of the radius Rk, preferably not more than 5% of the radius Rk, of the largest circle track or circular track 2*k*, and/or that the centers or center points, in particular of most, preferably of all, circle tracks or circular tracks 2*k*, 2*l*, 2*m*, 2*n*, 2*o*, 2*p* have a maximum distance from each other of not more than 3 mm, further preferably not more than 1 mm, in particular preferably not more than 0.5 mm. The radius Rk, Rl, Rm, Rn, Ro or Rp of the respective circle track or circular track 2*k*, 2*l*, 2*m*, 2*n*, 2*o* or 2*p* results in particular from the respective position of the allocated image point 3*k*, 3*l*, 3*m*, 3*n*, 3*o*, 3*p* of the image element $3^{VIII}$. The microstructures in the tracks 2*k*, 2*l*, 2*m*, 2*n*, 2*o*, 2*p* are preferably chosen and arranged in such a way that the image element $3^{VIII}$ appears in a desired illumination and observation situation. When the security element 1 is tilted or rotated, the image element $3^{VIII}$ preferably rotates with it about the center or the center point 4*k* of the circle tracks or circular tracks 2*k*, 2*l*, 2*m*, 2*n*, 2*o*, 2*p* along the tracks 2*k*, 2*l*, 2*m*, 2*n*, 2*o*, 2*p*. For example, the image element can represent a bird which flies in a circle in the case of tilting or rotation. It is likewise possible to lay circle tracks or circular tracks one on top of the other for a second image element in such a way that the microstructures are arranged and aligned in particular in such a way that the two image elements preferably do not light up at the same position. For example, the first image element can represent a dove and the second image element can represent an eagle. In the case of tilting or rotation, the eagle would preferably virtually fly behind the dove.

A security element 1 designed in such a way with identical or almost identical centers or center points of all circle tracks or circular tracks has in particular the advantage that fewer circle tracks or circular tracks overlap and the image elements preferably hereby appear brighter.

FIGS. 17*a* to 17*e* show the structure of a security document comprising a security element 1. Here, the centers or center points 4*q* of at least 75%, preferably at least 90%, particularly preferably of all, circle tracks or circular tracks 2*q*, 2*r*, 2*s*, 2*t*, 2*u* or circle track sections or sections of circular tracks 2*q*, 2*r*, 2*s*, 2*t*, 2*u* are identical or almost identical. By almost identical is preferably meant that the centers or center points 4*q*, in particular of most, preferably of all, circle tracks or circular tracks 2*q*, 2*r*, 2*s*, 2*t*, 2*u* or circle track sections or circular track sections 2*q*, 2*r*, 2*s*, 2*t*, 2*u* have a maximum distance from each other of not more than 10% of the radius Rq, preferably not more than 5% of the radius Rq, of the largest circle track or circular track 2*q* or of the largest circle track section 2*q*, and/or that the centers or center points 4*q*, in particular of most, preferably of all, circle tracks or circular tracks 2*q*, 2*r*, 2*s*, 2*t*, 2*u* or of all circle track sections or sections of circular tracks 2*q*, 2*r*, 2*s*, 2*t*, 2*u* have a maximum distance from each other of not more than 3 mm, further preferably not more than 1 mm, particularly preferably not more than 0.5 mm. The radius 2*q*, 2*r*, 2*s*, 2*t* or 2*u* of the respective circle track or circular track 2*q*, 2*r*, 2*s*, 2*t* or 2*u* or of the respective circle track section or circular track section 2*q*, 2*r*, 2*s*, 2*t* or 2*u* results in particular from the respective position of the allocated image point 2*q*, 2*r*, 2*s*, 2*t* or 2*u* of the image element $3^{IX}$. The microstructures in the circle tracks or circular tracks 2*q*, 2*r*, 2*s*, 2*t* or 2*u* or circle track sections or circular track sections 2*q*, 2*r*, 2*s*, 2*t* or 2*u* are preferably chosen and arranged in such a way that an image element $3^{IX}$ appears in a desired illumination and observation situation. When the security element 1 is tilted and/or rotated, the image element $3^{IX}$ preferably changes due to disappearing and/or re-appearing and/or continuously present image points 3*q*, 3*r*, 3*s*, 3*t*, 3*u* in such a way that an animation is to be detected by an observer. For example, the image element can represent a bird which flies in a circle in the case of tilting or rotation, and in the process appears to flap its wings.

FIGS. 17*b* to 17*e* show an animation of pips 3*q*, 3*r*, 3*s*, 3*t*, 3*u*, wherein the animation of five pips 3*q*, 3*r*, 3*s*, 3*t*, 3*u* "counts down" to two pips 3*q*, 3*u*, i.e. the number of pips decreases, in particular in the sequence of FIGS. 17*b* to 17*e*, in each case by one pip.

It is likewise possible to lay circle tracks or circular tracks one on top of the other for a second image element, wherein the microstructures are arranged and aligned in particular in such a way that the two image elements do not light up at the same position. For example, the first image element can represent the animation of a flying bird and the second image element can represent an unchanging image element, e.g. a denomination sign. The combination of an animation and a static image element is easy to communicate and thereby increases the protection against forgery.

LIST OF REFERENCE NUMBERS

1 security element
2, 2*a*, 2*b*, 2*c*, 2*d*, 2*e* track
20*a* inner contour of a track
20*b* outer contour of a track
21*a*, 22*a* partial areas of a track
3, 3' image elements
3*a*, 3*b*, 3*d*, 3*e* image points
300*a*, 300*b*, 300*c*, 300*d*, 300*e*, 300*f* connecting lines
30, 31, 32, 33 positions
4*a*, 4*b*, 4*c*, 4*d*, 4*e* center points of tracks
5 security document
51 document body
52 decorative layer
53 adhesive layer
54 protective layer
$R_a$, $R_b$, $R_c$, $R_d$, $R_e$ radii
B width
$\Lambda$ grating period
R1, R2 directions M center point
α azimuthal angle
10 first microstructures
20 second microstructures
100 first microstructure elements
10*a* sinusoidal grating
10*d* blazed grating
10*e* anisotropic matte structures
100*a*, 100*b*, 100*c* first microstructures
11, 12 intersection area
121, 122, 123 interruption
13, 131, 132 offset
14 mosaic surface
141, 142, 143, 144 partial mosaic surfaces
141*a*, 142*a*, 143*a*, 144*a* partial mosaic surfaces
15 free areas of surface
200*a*, 200*b* second microstructures
2*f*, 2*g*, 2*h*, 2*i*, 2*j* tracks
$\mathbf{3}^{II}$, $\mathbf{3}^{III}$, $\mathbf{3}^{IV}$, $\mathbf{3}^{V}$, $\mathbf{3}^{VI}$ image elements
3*f*, 3*g*, 3*h*, 3*i*, 3*j* image points
4*f*, 4*g*, 4*h*, 4*i*, 4*j* center points
Rf, Rg, Rh, Ri, Rj radii
2*k*, 2*l*, 2*m*, 2*n*, 2*o*, 2*p* tracks
$\mathbf{3}^{VIII}$ image element
3*k*, 3*l*, 3*m*, 3*n*, 3*o*, 3*p* image points
4*k* center point
Rk, Rl, Rm, Rn, Ro, Rp radii
2*q*, 2*r*, 2*s*, 2*t*, 2*u* tracks
$\mathbf{3}^{IX}$, $\mathbf{3}^{X}$, $\mathbf{3}^{XI}$, $\mathbf{3}^{XII}$ image element
3*q*, 3*r*, 3*s*, 3*t*, 3*u* image points
4*q* center point

The invention claimed is:

1. A security element with one or more microstructures providing a first item of optically variable information, wherein the one or more microstructures providing the first item of optically variable information are provided in one or more tracks which are curved at least in sections or in one or more sections of a track, which are curved at least in sections, and/or run along one or more tracks, which are curved at least in sections or along one or more sections of a track, which are curved at least in sections, and wherein the first item of optically variable information has one or more image elements, which are composed of a plurality of image points, wherein the plurality of image points are provided by the one or more microstructures, which are provided in different ones of the tracks, or run along different ones of the tracks, and wherein one or more of the image points moves along an allocated track when the security element is tilted and/or bent and/or rotated, when illuminated with at least one light source, and wherein the image points move along the respective track at a constant angular speed during the tilting and/or rotation of the security element.

2. The security element according to claim 1, wherein each of the image points is provided by an allocated one of the one or more microstructures providing the first item of optically variable information and each of the allocated one or more microstructures providing the first item of optically variable information is provided on a respectively allocated track of the one or more tracks, or runs along a respectively allocated track of the one or more tracks.

3. The security element according to claim 1, wherein the one or more microstructures providing the first item of optically variable information provide a sequence of image elements, which produce a movement effect, a morphing effect and/or a flip effect as first optical effect when the security element is tilted and/or bent and/or rotated.

4. The security element according to claim 1, wherein the one or more microstructures providing the first item of optically variable information produce a sequence of image elements as a first optical effect when the security element is tilted and/or bent and/or rotated.

5. The security element according to claim 1, wherein a sequence of the image elements is produced by a movement of the image points along the tracks when the security element is tilted and/or bent and/or rotated.

6. The security element according to claim 1, wherein at least one of the tracks is formed as a circular arc-shaped and/or circular track.

7. The security element according to claim 6, wherein one or more center points of the circular tracks are arranged randomly or pseudo-randomly.

8. The security element according to claim 1, wherein at least one of the tracks is formed as an elliptical track.

9. The security element according to claim 1, wherein at least one of the tracks is formed as a closed track or an open track.

10. A security element with one or more microstructures providing a first item of optically variable information, wherein the one or more microstructures providing the first item of optically variable information are provided in one or more tracks which are curved at least in sections or in one or more sections of a track, which are curved at least in sections, and/or run along one or more tracks, which are curved at least in sections or along one or more sections of a track, which are curved at least in sections, and wherein the first item of optically variable information has one or more image elements, which are composed of a plurality of image points, wherein the plurality of image points are provided by the one or more microstructures, which are provided in different ones of the tracks, or run along different ones of the tracks, and wherein at least one of the tracks is formed as a circular arc-shaped and/or circular track, and wherein two or more center points of the one or more center points of the circular tracks have a same position.

11. The security element according to claim 10, wherein one or more of the image points moves along an allocated track when the security element is tilted and/or bent and/or rotated, when illuminated with at least one light source.

12. The security element according to claim 10, wherein a width of at least one of the tracks changes along a progression direction of the respective track.

13. The security element according to claim 10, wherein a radius and/or a curvature and/or a radius of curvature of at least one of the tracks changes along a progression direction of the respective track.

14. The security element according to claim 10, wherein a width of the one or more tracks is between 3 μm and 300 μm.

15. The security element according to claim 10, wherein a curvature of one or more of the tracks, does not change over an entire progression of the respective track.

16. The security element according to claim 10, wherein at least one of the tracks has a different curvature progression from another of the at least one or more tracks.

17. The security element according to claim 10, wherein at least one of the tracks has a curvature progression that is identical to another of the at least one or more tracks.

18. The security element according to claim 10, wherein at least one of the tracks has a curvature of between 0.02 $mm^{-1}$ and 2 $mm^{-1}$.

19. The security element according to claim 10, wherein the security element has one or more microstructures providing a second item of optical information.

20. The security element according to claim 19, wherein at least one of the microstructures providing the first item of optically variable information comprises a plurality of microstructure elements and at least one of the microstructures providing the second item of optical information comprises a plurality of microstructure elements.

21. The security element according to claim 19, wherein the microstructures providing the second item of optical information are provided in an area of a surface which does not overlap with the tracks.

22. The security element according to claim 19, wherein the microstructures providing the second item of optical information are provided in an area of a surface which consists of two or more partial areas spaced apart from each other, which are formed striped and wherein one or more of the partial areas overlap with an allocated interruption area of the one or more tracks at least in areas.

23. The security element according to claim 10, wherein at least one of the tracks has one or more interruptions, in which the microstructures are not provided.

24. The security element according to claim 23, wherein at least one of the interruptions is arranged in one or more intersection areas of the respective one or more tracks.

25. The security element according to claim 24, wherein at least one of the interruptions is arranged outside one or more intersection areas of the respective one or more tracks.

26. The security element according to claim 24, wherein at least one of the interruptions is randomly and/or pseudo-randomly distributed parallel and/or perpendicular to one or more tangent vectors of the respective track.

27. The security element according to claim 10, wherein one or more of the tracks and/or one or more of the microstructures providing the first item of optically variable information have one or more offsets.

28. The security element according to claim 27, wherein at least one of the one or more of the offsets has a lateral dimension smaller than a width of a respective track.

29. The security element according to claim 27, wherein one or more of the offsets are randomly and/or pseudo-randomly distributed.

30. The security element according to claim 10, wherein a width of at least one of the tracks is smaller than a radius or a radii of the respective track.

31. A security element with one or more microstructures providing a first item of optically variable information, wherein the one or more microstructures providing the first item of optically variable information are provided in one or more tracks which are curved at least in sections or in one or more sections of a track, which are curved at least in sections, and/or run along one or more tracks, which are curved at least in sections or along one or more sections of a track, which are curved at least in sections, and wherein the security element has one or more microstructures providing a second item of optical information, and wherein at least one of the microstructures providing the first item of optically variable information comprises a plurality of microstructure elements and at least one of the microstructures providing the second item of optical information comprises a plurality of microstructure elements, and wherein at least one of the microstructure elements has at least one facet face, which forms a micromirror.

32. The security element according to claim 31, wherein the at least one facet face has a minimum surface area dimension of between 10 $\mu m^2$ and 5000 $\mu m^2$.

33. The security element according to claim 31, wherein the at least one facet face has an angle of inclination relative to a surface normal of the security element of between 1° and 45°.

34. The security element according to claim 31, wherein the at least one facet face has a smooth surface or convex or concavely curved surface.

35. The security element according to claim 31, wherein the at least one facet face represents at least one, achromatic, three-dimensional representation of a relief image, wherein an angle of inclination of the at least one facet face lies between 1° and 45°.

36. The security element according to claim 31, wherein, at least in a partial area of one or more of the tracks, a local orientation of one or more of the microstructure elements of the microstructure providing the first item of optically variable information, a local preferred direction and/or a local angle of inclination of one or more of the facets of the respective microstructure corresponds to a local curvature of the respective track.

37. The security element according to claim 36, wherein the partial area comprises at least 50% of a surface area and/or of a length of the respective track.

38. The security element according to claim 31, wherein, at least in a partial area of one or more of the tracks, a local orientation of one or more microstructure elements of the microstructure providing the first item of optically variable information, a local preferred direction and/or a local angle of inclination of one or more of the facets of the respective microstructure differs from a local curvature of the respective track by not more than 0° to 30°, wherein the local curvature is determined by a longitudinal edge of a respective track or by a centroid line of a respective track.

39. The security element according to claim 31, wherein, at least in a partial area of one or more of the tracks, a local orientation of one or more of the microstructure elements of a respective microstructure providing the first item of optically variable information, a local preferred direction and/or a local angle of inclination of one or more of the facets of the respective microstructure differs from a local curvature of the respective track by a predefined angle of deviation of +/−30°, wherein the local curvature is determined by a longitudinal edge of a respective track or by a centroid line of a respective track.

40. The security element according to claim 31, wherein, at least in a partial area of one or more of the tracks, a local orientation of one or more of the microstructure elements of the respective microstructure, a local preferred direction and/or a local angle of inclination of one or more of the facets of the respective microstructure has an angle relative to a local curvature of a respective track of between −45° and +45°, wherein the local curvature is determined by a longitudinal edge of a respective track or by a centroid line of a respective track.

41. A security element with one or more microstructures providing a first item of optically variable information, wherein the one or more microstructures providing the first item of optically variable information are provided in one or more tracks which are curved at least in sections or in one or more sections of a track, which are curved at least in sections, and/or run along one or more tracks, which are curved at least in sections or along one or more sections of a track, which are curved at least in sections, and wherein one or more of the tracks and/or one or more of the microstructures providing the first item of optically variable information intersect once or multiple times in one or more intersection areas, and wherein, in one or more of the intersection areas exclusively, the microstructure providing the first item of optically variable information of one of the tracks intersecting in the respective intersection area is provided.

42. The security element according to claim 41, wherein, in one or more of the intersection areas, the microstructure providing the first item of optically variable information is provided in a one- or two-dimensional grid.

43. The security element according to claim 41, wherein outside one or more of the tracks in an area of one or more of the intersection areas one or more areas of surface are provided, which is provided with one of the microstructures of the tracks intersecting in a respective intersection area.

44. A security element with one or more microstructures providing a first item of optically variable information, wherein the one or more microstructures providing the first item of optically variable information are provided in one or more tracks which are curved at least in sections or in one or more sections of a track, which are curved at least in sections, and/or run along one or more tracks, which are curved at least in sections or along one or more sections of a track, which are curved at least in sections, and wherein the security element has one or more microstructures providing a second item of optical information, and wherein the microstructures providing the second item of optical information are provided in an area of a surface which consists of two or more partial areas spaced apart from each other, which are formed striped.

* * * * *